US006640080B2

(12) United States Patent
Endo et al.

(10) Patent No.: US 6,640,080 B2
(45) Date of Patent: Oct. 28, 2003

(54) IMAGE FORMING APPARATUS AND IMAGE FORMING METHOD

(75) Inventors: Isao Endo, Hachioji (JP); Hiroyuki Yamada, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/029,331

(22) Filed: Dec. 20, 2001

(65) Prior Publication Data

US 2002/0081130 A1 Jun. 27, 2002

(30) Foreign Application Priority Data

| | | |
|---|---|---|
| Dec. 26, 2000 | (JP) | 2000-394648 |
| Feb. 6, 2001 | (JP) | 2001-029417 |
| Mar. 5, 2001 | (JP) | 2001-059659 |
| Mar. 5, 2001 | (JP) | 2001-059660 |

(51) Int. Cl.[7] ..... G03G 21/00
(52) U.S. Cl. ..... 399/349; 399/71; 399/350
(58) Field of Search ..... 399/349, 71, 350, 399/357, 345, 343; 430/125; 15/256.5, 256.51, 256.52

(56) References Cited

U.S. PATENT DOCUMENTS

| | | | | |
|---|---|---|---|---|
| 5,430,527 | A | * | 7/1995 | Maruyama et al. ..... 399/349 X |
| 5,646,718 | A | * | 7/1997 | Suwa et al. ..... 399/350 |
| 5,915,156 | A | * | 6/1999 | Kizaki et al. ..... 399/350 X |
| 6,029,025 | A | * | 2/2000 | Sakakibara et al. ..... 399/71 |
| 2002/0009316 | A1 | * | 1/2002 | Endo et al. ..... 399/349 |

FOREIGN PATENT DOCUMENTS

JP 2000-231320 * 8/2000

* cited by examiner

*Primary Examiner*—Sophia S. Chen
(74) *Attorney, Agent, or Firm*—Muserlian, Lucas and Mercanti

(57) ABSTRACT

An electrophotographic image forming apparatus is disclosed which has a cleaning unit with a cleaning roller that contacts the surface of the photoreceptor, a bias voltage applying device which applies a bias voltage to the cleaning roller, and a flat, board-shaped cleaning blade. The blade has an elastic body and a leading edge which contacts the surface of the photoreceptor downstream from the cleaning roller.

15 Claims, 6 Drawing Sheets

FIG. 6 ( a )
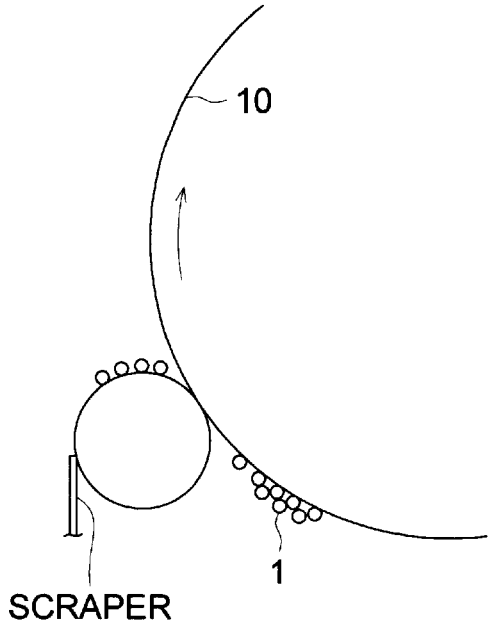
FIG. 6 ( b )
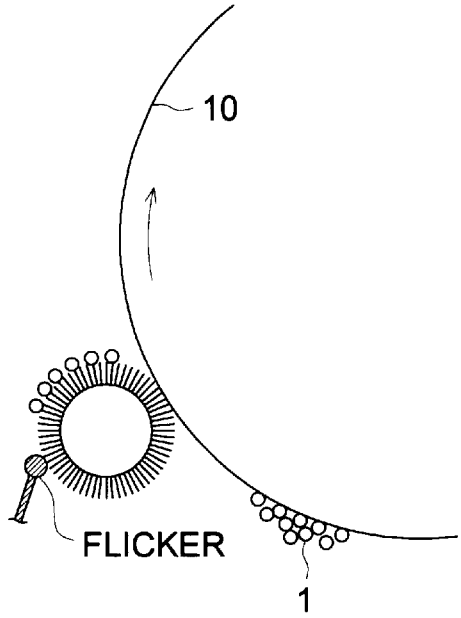
FIG. 6 ( c )
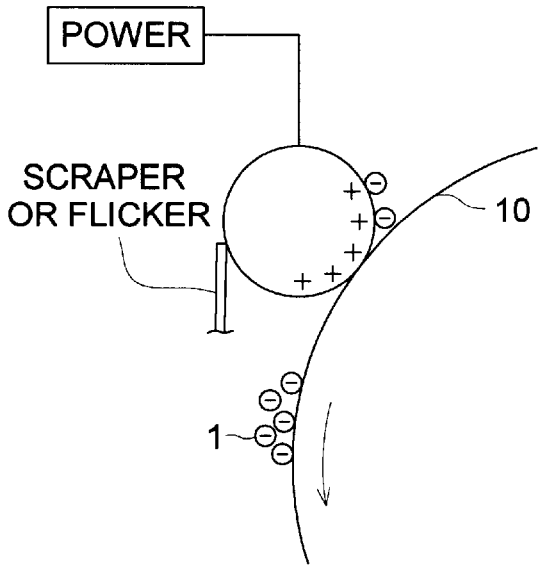

IMAGE FORMING APPARATUS AND IMAGE FORMING METHOD

FIELD OF THE INVENTION

The present invention relates to an image forming apparatus or an image forming method which is employed in copiers and printers.

BACKGROUND OF THE INVENTION

In recent years, in image forming apparatus to obtain high image quality at a high speed, an electrostatic latent image development system such as an electrophotographic system is almost exclusively employed. It is assumed that this trend will continue into the future. Therefore, it has been increasingly demanded to further improve image quality in said electrostatic latent image development system.

In the image forming apparatus employing an electrophotographic system, known as means to remove residual toner such as non-transferred toner and residual transferred toner on the photoreceptor are, for example, cleaning units employing a blade cleaning system in which a flat board-shaped cleaning blade, comprised of an elastic body, is brought into contact with the surface of the photoreceptor so as to remove said residual toner.

Cleaning blade holding systems in such cleaning units are mainly divided into a fixed holding system in which, for example, said cleaning blade is held employing a fixed type blade holder so that said cleaning blade is brought into pressure contact with the surface of the photoreceptor utilizing the elasticity of the blade itself, and a rotary holding system in which the cleaning blade is allowed to rotate around its axis, parallel to the rotational axis of the image holding body, and said cleaning blade is brought into pressure contact with the photoreceptor employing the action of a spring force or gravity. Among them, since it is possible to stably apply constant load to the photoreceptor over an extended period of time, those employing the rotary holding system are widely employed.

However, when the cleaning blade holding system is said rotary holding system, problems tends to occur such as so-called blade curl-under.

In recent years, from the viewpoint of achieving high image quality, a decrease in toner particle diameter has been demanded. Suitably employed as methods to prepare such toner particles have been polymerization methods such as an emulsion polymerization and a suspension polymerization method.

As a method to respond to said demand for further improvement of image quality, a decrease in particle diameter of the employed toner has been undertaken. However, as the particle diameter of said toner decreases, adhesive force such as van der Waals forces between said toner and the photoreceptor (in most cases, being an electrophotographic photoreceptor) increases compared to the weight of said toner. This fact results in a decrease in transfer efficiency of said toner onto the transfer material and a decrease in cleaning efficiency. As a result, the amount of toner which is not removed on said photoreceptor increases.

However, as the toner particle diameter decreases, adhesion force between toner particles and the photoreceptor increases. As a result, it becomes increasingly difficult to remove residual toner on the photoreceptor. Specifically, a so-called polymerization toner, which is prepared employing a polymerization method, is comprised of nearly spherical particles. The resultant toner particles roll on the photoreceptor, and pass under the cleaning blade. As a result, problems occur in which insufficient cleaning or insufficient residual toner removal tends to occur, whereby it becomes increasingly difficult to remove residual toner on the photoreceptor.

Said trend is more pronounced for the toner prepared employing a so-called polymerization method which is a suitable method to prepare toner particles having a minute diameter. When an emulsion polymerization method or a suspension polymerization is employed, toner particles are directly formed. As a result, in addition to the minute particle diameter, nearly spherical toner particles are formed, whereby the effective contact area between toner particles and the photoreceptor (hereinafter occasionally referred to as the electrophotographic photoreceptor or the photoreceptor) becomes large, and further, during cleaning, toner particles tend to roll on the surface of the photoreceptor. Due to that, "insufficient cleaning" occurs in which toner particles pass under the leading edge of the blade. On the other hand, in order to minimize such insufficient cleaning, when the cleaning member is excessively pressed onto the surface of the photoreceptor, the surface may be subjected to abrasion or toner particles are rubbed hard enough onto the surface to be crushed, whereby problems tend to occur on the surface of the photoreceptor. Said problems on the surface of the photoreceptor cause image problems such as white spots, white streaks, black spots, and black streaks. Accordingly, stable cleaning performance is not obtained over an extended period of time. As a result, when said problems are not overcome, it is impossible to achieve stable production of high quality images.

In order to minimize said insufficient cleaning, for example, Japanese Patent Publication Open to Public Inspection No. 3-179675 discloses a cleaning system in which mechanical cleaning and electrostatic cleaning are employed in combination.

Specifically, it is constituted in such a manner that a voltage applicable brush roller, comprised of conductive materials, is provided upstream from the cleaning blade with respect to the moving direction of the photoreceptor, and for example, a suitable bias voltage, having an opposite polarity of the residual toner on the photoreceptor, is applied to said brush roller. Thus, improvement of cleaning performance is attempted utilizing mechanical cleaning effects by the cleaning blade and electrostatic cleaning effects by the brush roller.

However, it is difficult to completely remove toner particles with a small particle diameter, and especially so are spherical toner particles which are prepared employing said polymerization method. Therefore, it has been demanded to develop a method to further enhance the cleaning performance. Further, in the image forming apparatus constituted as above, most residual toner on the photoreceptor is removed by the brush roller positioned upstream side respect to the moving direction of the photoreceptor. As a result, the amount of the residual toner, which reaches the cleaning blade, is frequently minimal. In such a case, frictional force on the photoreceptor increases so that blade curl-under as well as minute vibrations tend to occur. As a result, problems occur in which it becomes difficult to perform the stable production of high quality images over an extended period of time.

Furthermore, toner which is employed to visualize latent images formed on the photoreceptor is adhered to a wider area than the image forming area of the photoreceptor due to toner scattered by the development unit. Even though said cleaning system is employed, at present it is difficult to effectively remove the toner on the photoreceptor, which has been scattered over such a wide area.

In order to overcome such drawbacks, it has been considered to increase the cleaning area in the axis direction of the photoreceptor by increasing the width of the brush roller. However, when only the cleaning area is increased, the area, which is charged at a polarity opposite the residual toner, becomes excessively large due to the brush roller on the latent image holding member. As a result, in the opposite charge area which is charged by said brush roller and is not recharged by the charging unit, staining occurs due to toner adhesion as well as dielectric breakdown of the photosensitive layer of the photoreceptor. As a result, the apparatus interior tends to be stained and insufficient cleaning tends to occur.

Further, when the reversal development method, which is now mainly used in digital copiers, is employed, said problems are still more pronounced.

PROBLEMS TO BE SOLVED BY THE INVENTION

From the viewpoint of the foregoing, the present invention was achieved. An object of the present invention is to provide an image forming apparatus comprising a cleaning unit having a cleaning blade, which is capable of assuredly minimizing the formation of blade curl-under as well as minute vibrations, and is capable of producing high quality images over an extended period of time.

The other object of the present invention is to provide an image forming apparatus as well as an image forming method in which stable cleaning performance is obtained over an extended period of time and high quality images are formed without problems such as white streaks and black streaks.

Further other object of the present invention is to provide an image forming apparatus capable of assuredly removing residual toner on a photoreceptor as well as of minimizing staining in the interior of said apparatus, and subsequently capable of forming consistently high quality images over an extended period of time.

Further, another object of the present invention is to provide a cleaning unit having high cleaning performance, which results in minimized staining in the image forming apparatus in which said unit is installed.

The invention and its embodiment are described.

The image forming apparatus of the present invention comprises a rotationally driven photoreceptor and a cleaning unit which removes residual toner on said photoreceptor which has passed a transfer zone in which a toner image formed on said photoreceptor is transferred to a recording material in which said cleaning unit comprises a cleaning roller which is disposed so as to come into contact with the surface of said photoreceptor, a bias voltage applying means which applies a bias voltage to said cleaning roller, and a flat board-shaped cleaning blade comprised of an elastic body which is disposed so that the leading edge of said cleaning blade comes into contact with the surface of said latent image holding member downstream from said cleaning roller with respect to the movement direction of said photoreceptor, and said cleaning blade is supported rotatably around predetermined rotationally driven center axis O parallel to the rotational axis of said photoreceptor so that said cleaning blade is rotationally driven from the standard state in which the leading edge comes into contact with the surface of said photoreceptor while its total shape is not deformed and subsequently, is subjected to a working state while its entire body is curved, and the position of said rotationally driven center axis O is set so that said cleaning blade, in its standard state, satisfies the Conditions (1) and (2) described below:

Condition (1): in the cross-section perpendicular to the rotational axis of said photoreceptor, straight line T drawn between contact position P of the leading edge of said cleaning blade with said photoreceptor and said rotationally driven center axis O is positioned between tangential line N at said contact position P and said cleaning blade, and Condition (2): in the cross-section perpendicular to the rotational axis of said photoreceptor, contact angle θ of said cleaning blade with respect to the tangential line of said photoreceptor at said contact point P is from 0 to 30 degrees.

In the image forming apparatus of the present invention, the contact load on said cleaning blade is preferably from 5 to 50 g/cm.

Further, said bias voltage applying means is a constant current power source.

Still further, toner employed to form said toner image may be comprised of toner particles having a volume average particle diameter of 8.5 μm or less, which are prepared employing a polymerization method.

The image forming apparatus of the present invention comprises a rotationally driven photoreceptor, an image forming unit which forms a toner image on said photoreceptor employing toner comprising a lubricant as the external agent, a transfer unit which transfers said toner image formed employing said image forming unit onto a recording material in the transfer zone, and a cleaning unit which removes residual toner on said photoreceptor which has passed said transfer zone, wherein said cleaning unit comprises a cleaning roller which is disposed so as to come into contact with the surface of said photoreceptor, a bias voltage applying means which applies a bias voltage to said cleaning roller, and a flat board-shaped cleaning blade comprised of an elastic body which is disposed so that the leading edge of said cleaning blade comes into contact with the surface of said latent image holding member downstream from said cleaning roller with respect to the movement direction of said photoreceptor, and which comprises a control mechanism comprising a specified toner image forming function which forms a toner image for maintaining a blade effect to maintain the desired cleaning effect of said cleaning blade which reaches a cleaning zone employing said blade after passing said transfer zone.

In the image forming apparatus of the present invention, said control mechanism is capable of allowing said toner image for maintaining a blade effect to reach said cleaning zone, in which said cleaning blade is employed, by decreasing the cleaning effect obtained by said cleaning roller. In this case, when said toner image for maintaining the blade effect passes the cleaning zone in which said cleaning roller is employed, it is preferable that the cleaning effect obtained employing said cleaning roller is decreased by decreasing or eliminating the bias voltage which is applied to said cleaning roller.

In said image forming apparatus, it is possible to constitute it in such a manner that the specified toner image forming function of said control mechanism controls the operation of said image forming unit so that said toner image for maintaining the blade effect is formed at every specified image forming frequency.

Further, said bias voltage applying means is comprised of a constant current power source.

Still further, said toner employed to form a toner image may be comprised of toner particles, having a volume average particle diameter of 8.5 μm or less, which are prepared employing a polymerization method.

The image forming apparatus of the present invention comprising a photoreceptor which is rotationally driven, a charging unit which is arranged so as to face said photoreceptor while maintaining parallel to the axis, and charges said photoreceptor, a development unit which visualizes the latent image on said photoreceptor employing a toner, a transfer unit which is arranged to face said photoreceptor while maintaining parallel to the axis and transfers a toner image on said photoreceptor onto a recording material in the transfer zone, and a cleaning unit which removes the toner on said photoreceptor which passes through said transfer zone, in which said cleaning unit comprises a cleaning blade which comes into contact with the surface of said photoreceptor, a cleaning roller which comes into contact with the surface of said latent image holding member upstream with respect to the movement direction of said photoreceptor and is arranged to maintain parallel to the axis of said photoreceptor, and a bias voltage applying means which applies a bias voltage to said cleaning roller, is characterized in that formulas (1) and (2) described below are satisfied;

$$W2<W1 \quad \text{Formula (1)}$$

$$|W3-W1|\leq 30 \text{ (in mm)} \quad \text{Formula (2)}$$

wherein W1 is the effective cleaning area obtained by said cleaning roller in the axis direction of said photoreceptor, W2 is the effective transferring area of said transfer unit, and W3 is the effective charging area of said charging unit.

In the image forming apparatus of the present invention, it is preferable that the bias voltage applying means in said cleaning unit is a constant current power source.

Further, in said image forming apparatus, toner which is employed to visualize a latent image may be comprised of toner particles having a volume average particle diameter of 8.5 μm or less, which is prepared employing a polymerization method and further may be comprised of toner particles having a volume average particle diameter in the range of 2 to 32 μm, which have a CV value of no more than 20 percent.

Still further, in said image forming apparatus, the development unit may be constituted so that latent images formed on the photoreceptor are visualized employing a reversal development method.

The image forming apparatus of the present invention comprising a photoreceptor which is rotationally driven, a charging unit which is arranged to face said photoreceptor while maintaining parallel to the axis and charges said photoreceptor, a development unit which visualizes the latent image on said photoreceptor employing a toner, a transfer unit which is arranged to face said photoreceptor while maintaining parallel to the axis and transfers a toner image on said photoreceptor onto a recording material in the transfer zone, and a cleaning unit which removes the toner on said photoreceptor which passes through said transfer zone, in which said cleaning unit comprises a cleaning blade which comes into contact with the surface of said photoreceptor, a cleaning roller which comes into contact with the surface of said latent image holding member upstream with respect to the movement direction of said photoreceptor and is arranged to maintain parallel to the axis of said photoreceptor, and a bias voltage applying means which applies a bias voltage to said cleaning roller, is characterized in that said cleaning roller is insulated in its lateral direction in the part which is located beyond the part corresponding to the area effectively charged by said charging unit.

In said image forming apparatus, it is preferable that the bias voltage applying means in said cleaning unit is a constant current power source.

Further, in said image forming apparatus, toner which is employed to visualize a latent image may be comprised of toner particles having a volume average particle diameter of 8.5 μm or less, which are prepared employing a polymerization method. Further, the development unit may be constituted so that latent images formed on the photoreceptor are visualized employing a reversal development method.

The cleaning unit of the present invention comprising a cleaning blade which comes into contact with the surface of said rotationally driven latent image holding member, a cleaning roller which is arranged to come into contact with the surface of said photoreceptor upstream with respect to the movement direction of said latent image holding member from said cleaning position and to maintain parallel to the axis of said photoreceptor, and a bias voltage applying means which applies a bias voltage to said cleaning roller, is characterized in that said cleaning roller is conductive in its lateral direction in the part corresponding to the area in which the surface of said photoreceptor is effectively charged by said charging unit and is simultaneously insulated in the part beyond both edges of the part corresponding to said effectively charged area.

In one of the embodiments cleaning means comprises a cleaning roller comprised of an conductive or semi-conductive elastic body, a cleaning blade which is provided on the downstream side of said photoreceptor movement direction from said cleaning roller so as to come into contact with the surface of said photoreceptor, a constant current power source which applies a bias voltage having a polarity opposite the charging polarity of the toner which has contributed to the formation of said toner image in development utilizing said development means, and a removal means which removes any residual toner from said cleaning roller, and surface roughness Rz of said photoreceptor is from 0.1 to 2.5 μm.

The constant current power source outputs a constant current of 1 to 50 μA.

BRIEF DESCRIPTION OF THE DRAWINGS

FIGS. 6(*a*) to 6(*c*) are each a view showing an elastic/brush roller cleaning system.

DETAILED DESCRIPTION OF THE INVENTION

Figure 1:
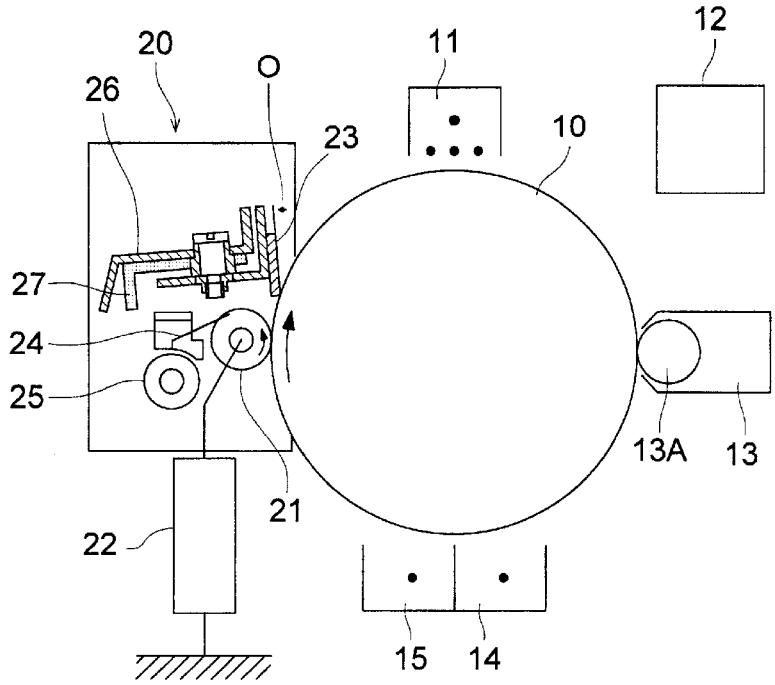
FIGS. 1(*a*) and 1(*b*) are schematic views showing the structure of one example of the image forming apparatus of the present invention.
Figure 1:
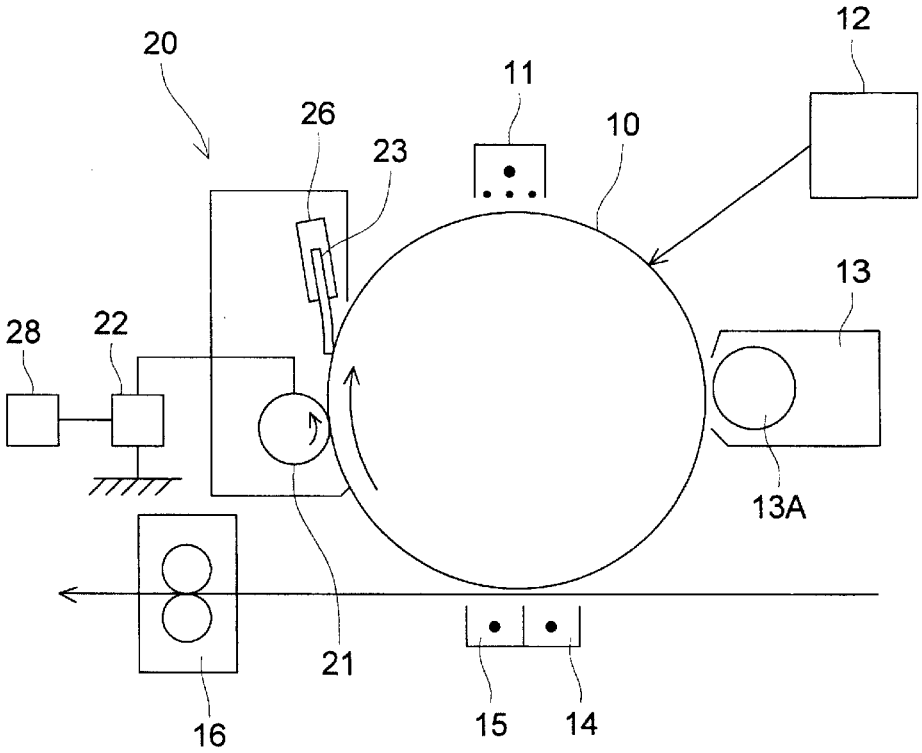

In the present invention, in addition to electrostatic cleaning obtained by employing the cleaning roller, mechanical cleaning employing a cleaning blade is carried out. As a result, high cleaning effects are exhibited, and it is possible to assuredly remove residual toner. Furthermore, the position of rotationally driven center axis O is set so that the state of the cleaning blade satisfies the specified conditions. As a result, the load, which is applied to the leading edge of the cleaning blade while the photoreceptor is rotationally driven, acts so as to rotate the cleaning blade in the direction to allow the cleaning blade to separate from the surface of the photoreceptor, utilizing rotationally driven center axis O as the center. Therefore, even when the amount of residual toner is minimal, it is possible to minimize the formation of curl-under as well as minute vibrations, and at the same time to allow the cleaning blade to provide sufficient residual toner removing ability. Consequently, desired cleaning effects obtained by employing the cleaning blade is stably exhibited over an extended period of time.

Further, in the present invention, by allowing the cleaning blade to remove toner images for maintaining blade effects, which are formed on the photoreceptor, a lubricating action is effected between the cleaning blade and the photoreceptor, employing toner comprising lubricants as the external agent which constitutes toner images for maintaining said blade effects. As a result, it is possible to retard friction forces acting on the leading edge of the cleaning blade to become excessive and to minimize the formation of blade curl-under as well as minute vibrations.

In the image forming apparatus of the present invention, in addition to mechanical cleaning employing a cleaning blade, electrostatic cleaning is carried out employing a cleaning roller. As a result, basically, highly effective cleaning is exhibited so that it is possible to assuredly remove residual toner on the photoreceptor. In addition, since effective cleaning area W1 of the cleaning roller is set in the specified range, it is possible to allow the electric removal field formed between the photoreceptor and the cleaning roller to act on the specified area with respect to the axis direction of the photoreceptor. As a result, it is possible to assuredly minimize interior apparatus staining due to toner adhesion as well as the formation of insufficient cleaning due to the dielectric breakdown of the photosensitive layer of the image holding body.

In the cleaning unit of the present invention, the part beyond both edges of the part corresponding the charged area of the photoreceptor is insulated in the lateral direction of the cleaning roller so that the part beyond the effectively charged area is not charged by the cleaning roller. As a result, interior apparatus staining due to toner adhesion as well as insufficient cleaning is minimized, whereby desired cleaning effects are continually exhibited over an extended period of time.

The cleaning roller has a surface resistivity of, preferably, $10^2$ to $10^{10}\Omega/\square$.

The cleaning roller is preferably comprised of an elastic body.

The cleaning roller is preferably comprised of a foamed material and a resinous film covering said foamed material.

The image forming apparatus preferably comprises a recycling means in which any toner recovered employing said cleaning means is re-supplied to said development means and reused.

The removal means is comprised of a blade.

In the image forming apparatus it is preferable that a plurality of said removal means is provided.

In the image forming apparatus, the photoreceptor preferably comprise a surface layer comprising a siloxane resin having a cross-linked structure.

The surface layer preferably comprises a siloxane resin based resin comprising structural units having charge transportability.

The photoreceptor is preferably comprised of a conductive support, an interlayer, a photosensitive layer, and a surface layer comprising a siloxane based resin having a crosslinked structure, and said layers are provided in said order.

The cleaning blade comes into contact with the photoreceptor preferably at a load of 0.1 to 30 g/cm utilizing a counter system and accomplishes a cleaning function.

The contact angle of cleaning blade to the photoreceptor is preferably at a 0 to 40 degrees utilizing a counter system.

The cleaning blade is comprised of an elastic body having a hardness in the range of preferably 20 to 90 degrees.

The toner employed in development preferably has a volume average particle diameter of 3 to 8.5 $\mu$m.

EMBODIMENTS OF THE INVENTION

The present invention will now be detailed with reference to the drawings.

Figure 2:
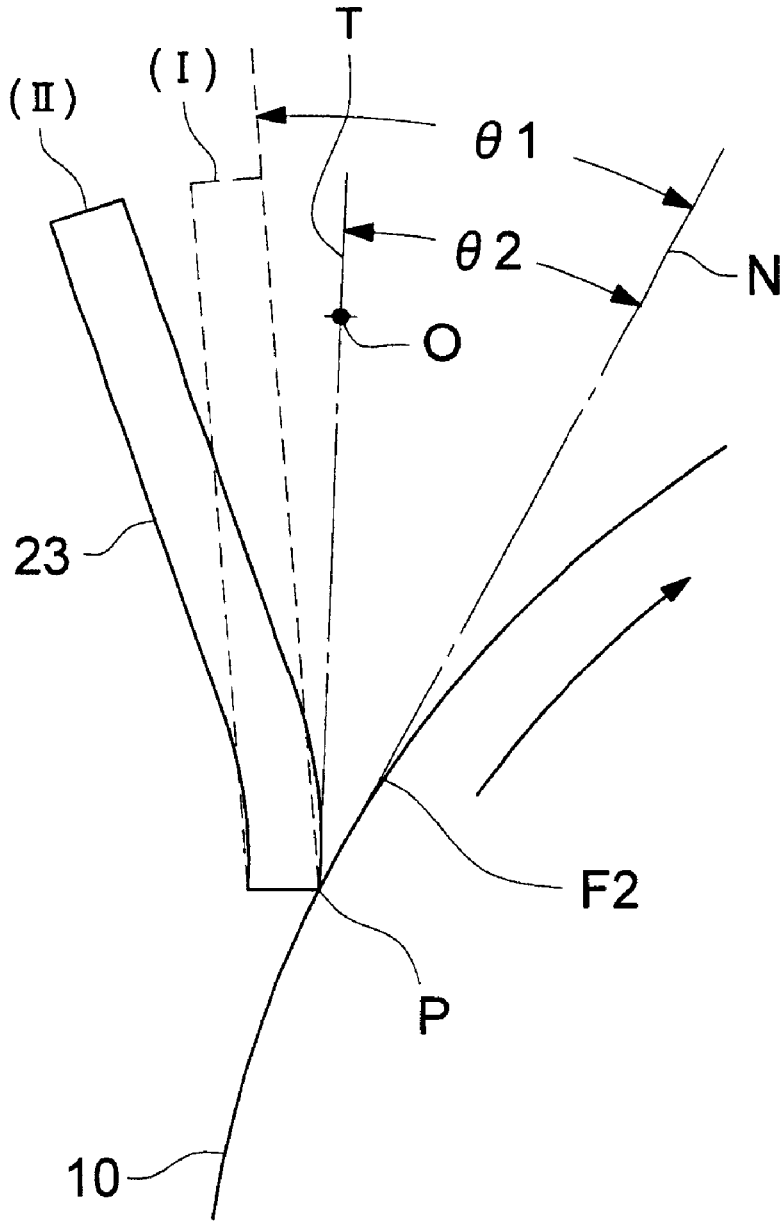
FIG. 2 is a view showing the contact state of the cleaning blade with the photoreceptor in FIG. 1(*a*).

FIGS. 1(*a*) and 1(*b*) each is a schematic view showing the structure of one example of the image forming apparatus of the present invention. FIG. 2 is a view showing. the contact state of a cleaning blade with a photoreceptor.

Said image forming apparatus comprises drum-shaped photoreceptor 10 which is rotationally driven, charging unit 11 which uniformly charges the surface of said photoreceptor 10, exposure unit 12 which exposes the surface of said photoreceptor 10 charged by said charging unit 11, development unit 13 which visualizes the electrostatic latent image formed by said exposure unit 12 employing a developer comprising a toner, a transfer unit 14 which transfers the toner image formed on photoreceptor 10 in the transfer zone onto a recording material, separation unit 15 which separates said recording material which comes into close contact with photoreceptor 10, and cleaning unit 20 which removes the toner 1 on photoreceptor 10 which passes through the transfer zone.

Photoreceptor 10 is comprised of, for example, an organic photoreceptor in which a photosensitive layer comprised of resins comprising organic photoconductive materials is formed on the external circumferential surface of a drum-shaped metallic base body, and is arranged to maintain parallel to the lateral direction (in FIG. 1(*a*), perpendicular direction to the paper surface) of the conveyed recording material.

The friction coefficient of the surface of photoreceptor 10 to the employed cleaning blade is preferably from 0.3 to 4.

Listed as resins which constitute the photosensitive layer having a friction coefficient in said range are, for example, polycarbonate resins, silicone resins, polystyrene resins, acrylic resins, methacrylic resins, epoxy resins, polyurethane resins, vinyl chloride resins, and melamine resins.

Development unit 13 is fitted with development sleeve 13A which is arranged to face photoreceptor 10 via a development zone. A direct current development bias having the same polarity as that of charging unit 11 or a development bias in which a direct current voltage having the same polarity as charging unit 11 is superposed onto the alternative current voltage, is applied to said development sleeve 13. By so doing, reversal development is carried out in which toner is adhered onto the area exposed by exposure unit 12.

Cleaning unit 20 comprises conductive or semiconductive cleaning roller 21 arranged to come into contact with the surface of photoreceptor 10, bias voltage applying means 22 which applies a bias voltage to said cleaning roller 21, and flat board-shaped cleaning blade 23 comprised of an elastic body such as urethane rubber, which is arranged to come into contact with the surface of photoreceptor 10 downstream with respect to the moving direction of photoreceptor 10, and to extend the leading edge toward the opposite direction of the movement of photoreceptor 10. Further, both cleaning roller 21 and said cleaning blade are arranged to be parallel to the rotational axis of photoreceptor 10.

In FIG. 1(*a*), numeral 24 is a scraper provided on cleaning roller 21, which recovers toner on cleaning roller 21. The recovered toner is conveyed to development unit 13 employing recovery roller 25 which is arranged to maintain parallel to cleaning roller. The recovered residual toner is conveyed to development unit 13, employing the recovery roller 25 and reused.

From the viewpoint of obtaining an excellent contact state with photoreceptor 10, cleaning roller 21 is comprised of an elastic body. Employed as materials of said elastic body may be rubber materials, conventionally known in the art, such as silicone rubber and polyurethane, foamed rubber body or those which are prepared by covering a foamed rubber body with resins.

Cleaning roller 21 is either conductive or semiconductive, and its surface resistance is preferably from $10^2$ to $10^{10}$ Ωcm. When said surface resistance is $10^2$ Ωcm or less, banding due to discharge tends to occur. On the other hand, when it exceeds $10^{10}$ Ωcm, the potential difference necessary for removing toner is not obtained, whereby insufficient cleaning tends to occur.

Further, it is possible to adjust said surface resistance by adding conductive materials such as carbon, metals and conductive polymers to elastic body materials constituting cleaning roller 21, or by introducing polar groups to the same.

The surface resistivity of the cleaning roller is the value determined at normal temperature and normal humidity (26° C. and 50 percent relative humidity) under an applied voltage of 10 V in a measurement time of 10 seconds, employing Hirester IP (MPC-HT250) and HA Rope, manufactured by Mitsubishi Yuka Co., Ltd.

Further, the thickness of said conductive or semiconductive elastic layer varies depending on the surface resistivity and hardness of the employed materials, but is preferably set from about 0.5 to about 50 mm in order to assure suitable resistance values as well as the nip width. Further, the volume resistivity of roller materials is preferably in the range of $10^2$ to $10^{10}$ Ωcm.

The surface resistivity of said cleaning roller is the value determined at normal temperature and normal humidity (26° C. and 50 percent relative humidity) under an applied voltage of 10 V in a measurement time of 10 seconds, employing Hirester IP (MPC-HT250) and HA Rope, manufactured by Mitsubishi Yuka Co., Ltd.

At the contact position with photoreceptor 10, it is preferable that cleaning roller 21 rotates so as to move in the same direction as photoreceptor 10, namely rotates in the opposite direction (in the example of FIG. 1(*a*), the counterclockwise direction) in the opposite-direction of photoreceptor 10. When cleaning roller 21 rotates in the same direction as photoreceptor 10 and the excessive amount toner is present on the surface of photoreceptor 10, toner removed by cleaning roller 21 may be spilt and may occasionally stain recording materials as well as the interior of the apparatus.

Further, the linear speed ratio Vr/Vp of the linear speed Vr of cleaning roller 21 to the linear speed Vp of photoreceptor 10 is preferably from 0.5 to 2.0. When said linear speed ratio is 0.5 or less, image staining tends to occur due to a decrease in cleaning ability. On the other hand, when said ratio exceeds 2.0, the surface tends to be damaged by including foreign matter.

Bias voltage applying means 22, connected to cleaning roller 21, is comprised of, for example, a constant current power source. Subsequently, electric current is applied to cleaning roller 21 so that a bias voltage having a polarity opposite that of the toner, which is employed to visualize electrostatic latent images on photoreceptor 10, so that, for example, when said toner is negatively charged, a positive bias voltage is applied to cleaning roller 21. As a result, said toner is electrostatically attracted by said cleaning roller, and removed from the surface of photoreceptor 10.

Employed as power source 22 is a constant current power source which applies said bias voltage.

The constant current power source, as described herein, refers to a power source which is structured so as to control the output voltage in response to the resistance between the cleaning roller and the photoreceptor, so that a constant current value is always outputted.

After image transfer, an electrostatic charge is present on photoreceptor 10, and the electric potential on said photoreceptor is not uniform. However, by applying said bias voltage to said cleaning roller, utilizing said constant current power source, when toner is electrostatically attracted to said cleaning roller, a nearly constant electric field is formed between the surface of said photoreceptor and the surface of said cleaning roller. As a result, uniform cleaning effects are obtained, whereby excellent cleaning effects are achieved. Further, since great difference in electric potential is not locally formed, discharge also barely occurs.

The current value, which is applied to cleaning roller 21 employing bias voltage applying means 22, varies depending on the thickness of the photosensitive layer of photoreceptor 10 and the surface resistance of cleaning roller 21, but is preferably from 1 to 50 μA in terms of an absolute value. When said current value is 1 μA or less, it becomes difficult to achieve sufficient cleaning, while when said value exceeds 50 μA, discharge tends to occur.

For example, when the thickness of the photosensitive layer of photoreceptor 10 is from 15 to 30 μm and the surface resistance of cleaning roller 21 is from $10^2$ to $10^{10}$ Ωcm, the current value applied to cleaning roller 21 is preferably from 5 to 40 μA in terms of an absolute value.

As shown in FIG. 1(*a*), it is preferable that by allowing scraper 24, as the removal means, to come into contact with cleaning roller 21, matter to be removed such as toner, which has been transferred from photoreceptor 10 to cleaning roller 21, is removed.

Employed as scraper 24 are elastic plates such as phosphor bronze plates, polyethylene terephthalate plates, and polycarbonate plates. Said scraper 24 may come into contact with cleaning roller 21 in either a trailing system, in which a tip forms an acute angle on the non-cleaning side of said cleaning roller 21, or a counter system in which a tip forms an acute angle on the cleaning side of said cleaning roller 21.

Further, other than said scraper, it is possible to employ rollers as well as brushes as the removal means. Toner recovered by scraper 24 is charged into development unit 13 together with toner recovered by cleaning blade 23, employing recycling means and reused. A plurality of removal means such as scraper may be provided. When cleaning ability of cleaning roller is enhanced, recovery is preferably carried out employing a plurality of scrapers, since the toner adheres tightly to cleaning roller 21 under an electrostatic force.

The hardness of said cleaning roller is preferably in the range of 5 to 60 degrees, and is more preferably from 10 to 50 degrees. When said hardness is less than 5 degrees, the durability is not sufficient, while when said hardness exceeds 60 degrees, it becomes difficult to assure the contact width between said photoreceptor and said cleaning roller, and further, the photoreceptor surface tends to be abraded. Incidentally, the hardness of said cleaning roller is the value obtained by measuring the elastic body after molding said roller, employing Asker C Hardness Tester (at a load of 300 gf).

The contact width between said photoreceptor and said cleaning roller is preferably in the range of 0.2 to 5 mm, and is more preferably in the range of 0.5 to 3 mm. When said contact width is less than 0.2 mm, the cleaning ability becomes insufficient, while when said contact width exceeds 5 mm, said photoreceptor tends to be abraded, due to sliding.

The portion on the end of cleaning blade 23 is held employing rotary type blade holder 26, arranged rotatably around predetermined rotationally driven center axis O which is disposed to be in parallel to the rotational axis of photoreceptor 10. Said cleaning blade 23 rotates while being pressed by pressing means 27 provided on blade holder 26 from standard state (I) in which said cleaning blade comes into contact with the surface of photoreceptor 10 without any deformation of its shape. Subsequently, the portion on the end is subjected to movement in the direction separating from photoreceptor 10 (being the counterclockwise rotation utilizing the rotationally driven center axis O as the center) so as to result in working state (II) in which the entire cleaning blade 23 is bent and is brought into pressure contact with photoreceptor 10 in a state in which the contact load to photoreceptor 10 is controlled at a definite magnitude (refer to FIG. 2).

As shown in FIG. 2, the position, at which rotationally driven center axis O is arranged, is set so that cleaning blade 23 satisfies Conditions (1) and (2) described below at its standard state (I).

Condition (1)

In the cross-section perpendicular to the rotational axis of photoreceptor 10, straight line T drawn between contact position P of the leading edge of cleaning blade 23 and said rotationally driven center axis O is positioned between tangential line N of photoreceptor 10 at said contact position P and cleaning blade 23, namely fulcrum angle θ2 formed between tangential line N of photoreceptor 10 at contact point P and straight line T drawn between contact position P and rotationally driven center axis O, is smaller than contact angle θ1 formed between tangential line N of photoreceptor 10 at contact point P and cleaning blade 23.

Condition (2)

In the cross-section perpendicular to the rotational axis of photoreceptor 10, contact angle θ1 of cleaning blade 23 with respect to tangential line N of photoreceptor 10 at contact point P is preferably from 0 to 30 degrees.

Further, said contact angle θ1 is more preferably from 5 to 25 degrees.

As noted, cleaning blade 23 is comprised of an elastic body. Its repulsion elasticity modulus is preferably from 10 to 80 percent at 25° C., and is more preferably from 30 to 70° C. Due to that, it is possible to assuredly minimize blade curl-under as well as minute vibrations, whereby it is possible to produce high quality images over an extended period of time.

The repulsion elasticity modulus, as described herein, is a value determined based on JIS K 6255.

JIS A Hardness of cleaning blade 23 is preferably from 20 to 90 degrees, and is more preferably from 60 to 80 degrees. When JIS A Hardness is 20 degrees or less, cleaning blade 23 becomes excessively soft, whereby blade curl-under is more likely to occur. On the other hand, when JIS A Hardness exceeds 90 degrees, it becomes difficult to allow cleaning blade 23 to follow slight unevenness or to ride over foreign matter, whereby insufficient residual toner removal tends to occur.

JIS A Hardness, as described herein, means a value determined based on JIS K 6253.

Said cleaning blade can be prepared by employing elastic bodies, such as polyurethane.

The contact load of cleaning blade 23 to photoreceptor 10 is preferably from 0.1 to 30 g/cm, and is more preferably from 1 to 25 g/cm. When said contact load is 0.1 g/cm or less, cleaning ability becomes insufficient so that image staining tends to occur. On the other hand, when said contact load exceeds 30 g/cm, photoreceptor 10 is subjected to excessive abrasive wear so that image blurring tends to occur.

Said contact load is determined employing a method in which the contact load is determined by pressing the leading edge of cleaning blade 23 against a scale or a method in which a the contact load is electrically determined by providing a sensor, such as a load cell, at the contact position of photoreceptor 10 and the leading edge of cleaning blade 23.

The thickness as well as the free length of cleaning blade 23 is not particularly limited as long as the contact load as well as contact angle θ1 of cleaning blade 23 is in said range. However from the viewpoint of enhancing controllability of the contact load as well as minimizing the formation of blade curl-under, the thickness of said cleaning blade is preferably from 1 to 3 mm, and is more preferably from 1.5 to 2.5, while the free length is preferably from 2 to 20 mm, and is more preferably from 3 to 15 mm. "Free length", as described herein, refers to the length of non-restricted portion from blade holder 26, that is the length of the part from the bottom plane of blade holder 26 to the leading edge of cleaning blade 23.

The contact angle θ of cleaning blade 23 to photoreceptor 10 is preferably from 0 to 30 degrees, and is more preferably from 0 to 25 degrees. When contact angle θ is 0 degree or less, cleaning ability decreases so that image staining tends to occur.

In the foregoing, each cleaning area, affected by cleaning roller 21 as well as cleaning blade 23, has been set so as to be greater than the image forming area across the width of photoreceptor 10 (being the rotational direction).

Further, it is preferable that the width of cleaning blade 23 is basically the same as that of cleaning roller 21. However, even though there is about a 5 mm difference at each end from the design conditions of the apparatus, no problem occurs for commercial viability.

Figure 4:
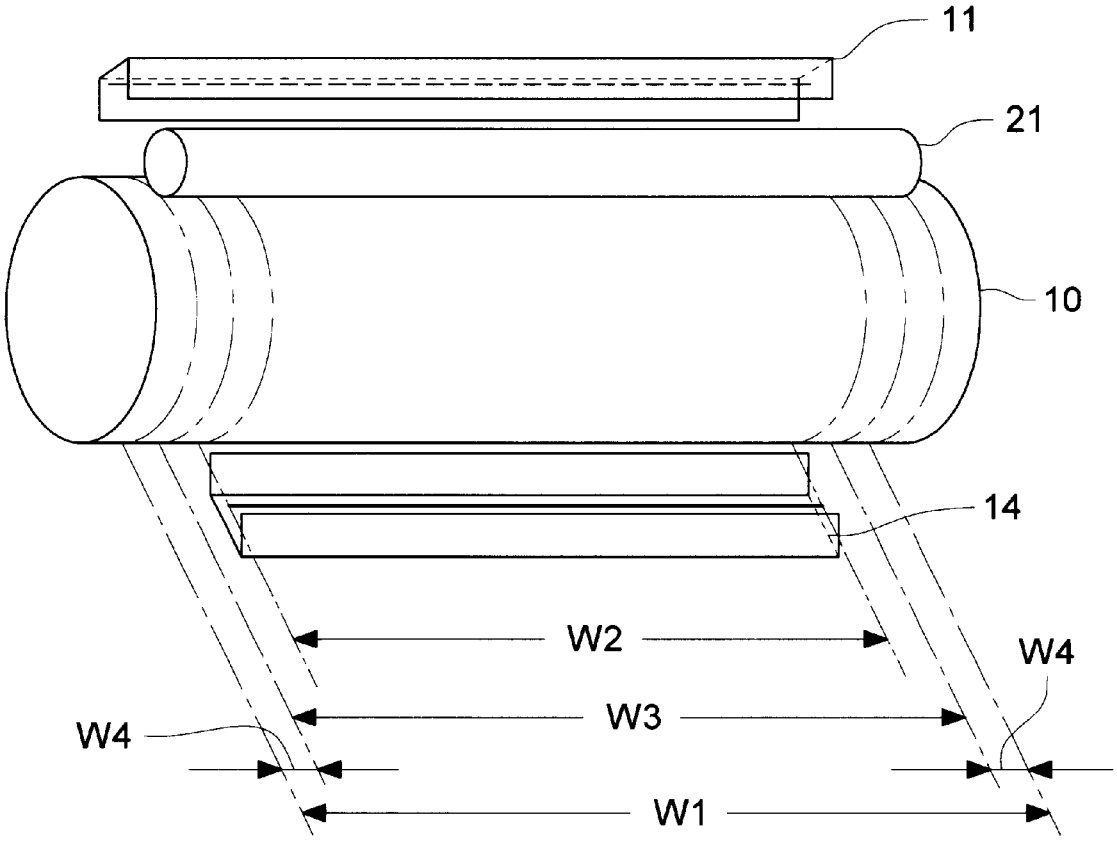
FIG. 4 is a perspective view showing one example of the relationship between the effective cleaning area of a cleaning roller, the effective transferring area of a transfer unit, and the effective charging area of a charging unit.

As shown in FIG. 4, in the image forming apparatus of the present invention, when, in the axis direction (being the lateral direction) of photoreceptor 10, an effective cleaning of cleaning roller 21 is represented by W1 while an effective transferring area of transfer unit 14 is represented by W2, the arrangement is such that effective cleaning area W1 is greater than effective transferring area W2. As a result, employing cleaning roller 21, it is possible to assuredly remove toner, which has been scattered beyond effective cleaning area W2 and adhered onto photoreceptor 10.

"Effective cleaning area W1", as described herein, refers to the width in which, in the lateral direction of photoreceptor 10, a removal electric field formed between photoreceptor 10 and cleaning roller 21 works effectively. "Effective transferring area W2", as described herein, refers to the width in which, in the lateral direction of photoreceptor 10, discharge obtained by transfer unit 14 works effectively. Further, when said transfer unit 14 is of a contact type, the width of said transfer unit 14, which comes into contact with the surface of photoreceptor 10, is regarded as effective transferring area W2.

Effective cleaning area W1 is preferably at least 3 mm, and preferably at least 7 mm greater than effective transfer area W2 at each end. Due to that, it is possible to remove toner which has been scattered over a wider range with respect to the lateral direction of photoreceptor 10. On the other hand, when effective transfer area W2 is greater than effective cleaning area W1, it is impossible to remove toner which has been scattered beyond effective transfer area W2 and subsequently adheres to photoreceptor 10. As a result, charge electrodes as well as optical systems are stained, whereby image problems such as background staining and white streaking occur.

Further, when, across the width, effective charging area of charging unit 11 is represented by W3, the absolute value of the differences between effective charging area W3 and effective cleaning area W1 is to be $|W3-W1| \leqq 30$. By satisfying said formula, it is possible to assuredly recharge the specified area, whereby it is possible to assuredly minimize insufficient cleaning due to dielectric breakdown of the photosensitive layer of photoreceptor 10 and also assuredly minimize interior apparatus stain due to toner adhesion.

"Effective charging area", as described herein, refers to the width of photoreceptor 10 in which discharge obtained by charging unit 11 works effectively. Further, when said charging unit is of a contact type, the width of said charging unit, which comes into contact with the surface of photoreceptor 10, is regarded as effective charging area W3.

One example of the area size in said image forming apparatus will now be described. For example, when effective transferring area W2 of transfer unit 14 is 300 mm, effective cleaning area W1 is set at 306 mm or more which is at least 3 mm greater at each end than effective transferring area W2. When effective cleaning area W1 is set at 306 mm, effective charging area W3 obtained by charging unit 11 is set at 276 to 336 mm. In order to minimize a reversal charging area (being W4 in FIG. 4) which is charged by cleaning roller 11 and is not recharged by charging unit 11, it is preferable that effective charging area W3 is set to be as close as possible to effective cleaning area W1 or to be greater than effective cleaning area W1.

The surface of photoreceptor 10, which is rotationally driven, is successively charged to the specified polarity (for example, negative polarity). By selectively irradiating light onto the surface of the resulting photoreceptor 10 employing exposure unit 12, the electric potential in the light irradiated area (being the exposed area) decreases and results in formation of an electrostatic latent image corresponding to the original document. Further, the surface of development sleeve 13A constituting development unit 13 is charged to the same polarity (for example, the negative polarity) as that of the surface potential of photoreceptor 10, employing a development bias applied from a power source (not shown) and developer comprising toner, which is charged to the same polarity (for example, negative polarity) as that of the surface potential of development sleeve 13A, is conveyed to a development zone.

Surface potential Vh of the unexposed area of photoreceptor 10, surface potential V1 of the exposed area of photoreceptor 10 and surface potential Vd of development sleeve 13A all have the same polarity and their absolute values are represented by the relationship of $Vh>Vd>V1$. Accordingly, toner on development sleeve 13A is adhered to the exposed area, whereby reversal development is carried out. A toner image formed on photoreceptor 10 is then transferred to a recording material. The recording material to which said toner image has been transferred is separated from the surface of photoreceptor 10, employing separation unit 15, and is then subjected to a fixing treatment in fixing unit 16.

On the other hand, a bias voltage in response to the volume of the electric current controlled by control unit 28 is applied to cleaning roller 21 constituting cleaning unit 20, employing a bias voltage applying means, and said cleaning roller 21 is charged to the opposite polarity (for example, positive polarity) of the residual toner on photoreceptor 10 which has passed through the transfer zone, whereby most residual toner on photoreceptor 10 is removed. After the residual toner passing through cleaning roller 21 is mechanically removed by cleaning blade 23, photoreceptor 10 is recharged by charging unit 11, and said operation is repeated.

Further, recovered residual toner is conveyed to development unit 13, employing recovery roller 25 and reused.

By employing said image forming apparatus, in addition to mechanical cleaning of cleaning blade 23, electrostatic cleaning is carried out employing cleaning roller 21. As a result basically, high cleaning effects are exhibited and the residual toner on photoreceptor 10 is assuredly removed. In addition, since effective cleaning area W1 of cleaning roller 21 is set in the specified range, it is possible to allow the removal electric field formed between photoreceptor 10 and cleaning roller 21 to act on the specified area in the lateral direction of photoreceptor 10. As a result, it is possible to assuredly minimize interior apparatus staining due to toner adhesion as well as insufficient cleaning due to dielectric breakdown of the photosensitive layer of photoreceptor 10.

Specifically, since effective cleaning area W1 is greater than effective transferring area W2 of transfer unit 14, it is possible to allow the removal electric field to act on toner scattered and adhered beyond effective transferring area W2 across photoreceptor 10. As a result, it is possible to assuredly remove said toner. At the same time, since effective cleaning area W1 and effective charging area W3 of charging unit 11 satisfies the formula of $|W3-W1| \leqq 30$, it is possible to minimize the area which is charged by cleaning roller 21 on photoreceptor 10 and is not recharged by charging unit 11, which is the area charged to the opposite polarity of the toner. As a result, it is possible to minimize toner adhesion as well as toner accumulation in said opposite polarity area, and dielectric breakdown of the photosensitive layer of photoreceptor 10, whereby it is possible to maintain high cleaning performance over an extended period of time and also to form high quality images.

When bias voltage applying means 22 in cleaning unit 20 is a constant current power source, is generated electric potential difference, which is sufficient enough to run at a constant current between the surface of cleaning roller 21 and the surface of photoreceptor 10, and at the same time, the resulting potential difference is kept constant in response to the surface potential of photoreceptor 10. As a result, it is possible to assuredly minimize unevenness due to the potential level and polarity of photoreceptor 10 as well as insufficient cleaning, compared to the case in which a constant voltage power source is employed.

Figure 5:
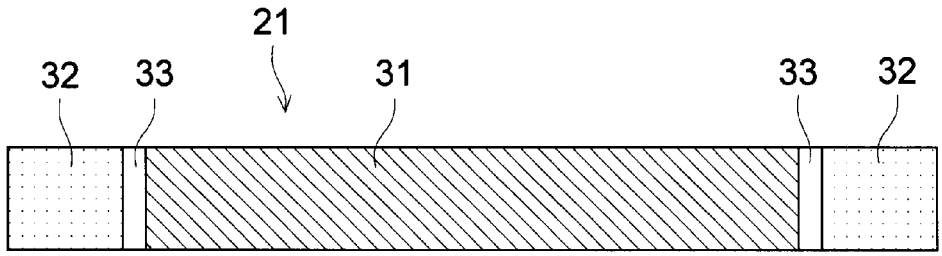
FIG. 5 is a view showing another example of the constitution of a cleaning roller.

As shown in FIG. 5, in the image forming apparatus of the present invention, it is preferable that cleaning roller 21 constituting cleaning unit 20 is comprised of conductive portion 31 and insulated portion 32 which are located beyond both ends of said conductive portion 31 in the lateral direction.

Specifically, in said cleaning roller 21, the portion corresponding to effective charging area W3 of charging unit 11, is comprised of a conductive or semi-conductive material, and at the same time, a part beyond the part corresponding to effective charging area W3 is comprised of insulating materials. Further, in order to minimize discharge from conductive portion 31, cleaning roller constituting materials, each of which has different surface resistance, is joined via, for example, insulating buffer member 33.

The surface resistance of insulated portion 32 is preferably at least $10^{11}$ Ωcm, and is more preferably at least $10^{13}$ Ωcm. By adjusting the surface resistance to the preferred range, it is possible to assuredly minimize discharge due to the electric current applied by cleaning roller 21 as well as charge accumulation on photoreceptor 10.

Said surface resistance is obtained based on V/IW, wherein V is the constant voltage applied to cleaning roller 21 when said cleaning roller is provided on a flat conductive board, I is the electric current running from said flat board, and W is the contact width of said flat board and cleaning roller 21.

The length of insulated portion 32 is preferably from 2 to 80 mm. By adjusting said length to said range, it is possible to assuredly minimize the occurrence in which toner, which has been recovered, is scattered on the ends of photoreceptor 10 and re-adheres onto said photoreceptor 10.

In said image forming apparatus, the portion located in the position beyond both ends of conductive portion 31, corresponding to effective charging area W3, is insulated. As a result, on the surface of photoreceptor 10, an opposite charge area, which is charged by cleaning roller and is not recharged by charging unit 11, is not formed. Namely, since the surface of photoreceptor 10 is assuredly recharged by charging unit 11, neither interior apparatus staining due to toner adhesion, nor insufficient cleaning due to dielectric breakdown of the photosensitive layer occurs, whereby it is possible to maintain high cleaning performance over an extended period of time and still to form high quality images.

Further, since insulated portion 32 is formed on cleaning roller 21, it is possible to minimize occurrence in which toner, which has been recovered, is scattered on the sides of photoreceptor 10 and adheres onto said photoreceptor 10.

As noted above, in the image forming method of the present invention, in addition to mechanical cleaning by cleaning blade 23, electrostatic cleaning by cleaning roller 21 is conducted. As a result, without an increase in contact load of cleaning blade to photoreceptor 10, it is possible to obtain higher cleaning performance without fluctuations over an extended period of time. Therefore, marked effects are exhibited by employing organic photoreceptors which have not been employed in the conventional cleaning units, due to the fact that it was impossible to increase contact load of cleaning blade 23 and to still obtain stabilized cleaning performance over an extended period of time.

Figure 3:
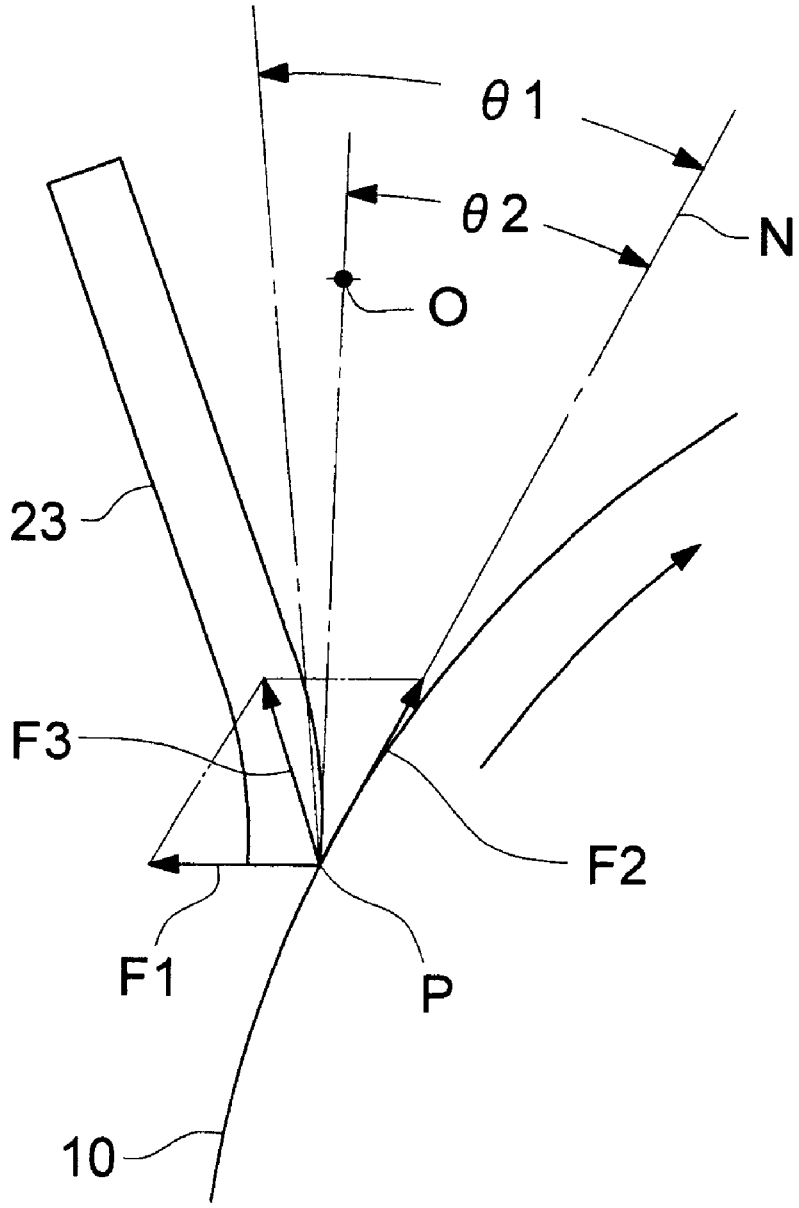
FIG. 3 is a view showing the operational state of the cleaning blade.

FIG. 3 is referred to. By employing said image forming apparatus, in addition to electrostatic cleaning affected by employing cleaning roller 21, mechanical cleaning is carried out employing cleaning blade 23. As a result, basically high cleaning effects are exhibited and the residual toner on photoreceptor 10 is assuredly removed. In addition, since the position of rotationally driven center axis O is set so that cleaning blade 23 is brought into a state which satisfies the specified conditions, it is possible to assuredly minimize the formation of blade curl-under as well as minute vibrations.

Specifically, as shown in FIG. 3, by rotationally driving photoreceptor, reaction force F1 of the pressure contact force on photoreceptor is allowed to act on the leading edge of cleaning blade 23, which comes into contact with the surface of photoreceptor, in the circumferential direction of the circular orbit which is drawn by the leading edge of cleaning blade 23 at contact point P, utilizing rotationally driven center axis O as the center and at the same time, friction force F2 on photoreceptor is allowed to act on the same direction (being the direction of tangential line N from contact point P) which is the same as the rotation direction of photoreceptor. As a result, resultant force F3 between reaction force F1 of pressure contact force F and friction force F2 totally acts on the direction to press-deform cleaning blade 23.

Further, since the position of rotationally driven center axis O is set so that the cleaning blade is in the state which satisfies above Condition (1), it is possible to allow resultant force F3 of reaction force F1 of the pressure contact force and friction force F2 to act on cleaning blade 23 so as to be rotationally driven in the direction to separate said cleaning blade 23 from the surface of photoreceptor, utilizing rotationally driven center axis O as the center. As a result, it is possible to assuredly minimize the formation of blade curl-under as well as minute vibrations. Further, since cleaning blade 23 is provided in the state which satisfies above Condition (2), it is possible to obtain sufficient toner removal ability (cleaning ability). Accordingly, even when a small amount of toner reaches the cleaning zone in which cleaning blade 23 is employed, predetermined cleaning effects obtained by employing cleaning blade 23 is exhibited, whereby it is possible to achieve stable production of high quality images.

Still further, other than the formation of ordinary toner images corresponding to images of original documents, it is possible to constitute the image forming apparatus of the present invention in which a control mechanism (not shown) is provided which comprises a specified toner image forming function which forms blade effect-maintaining toner images (hereinafter occasionally referred to as "specified toner images") to maintain effects of cleaning blade 23, which reach the cleaning zone employing cleaning blade 23 after passing the transfer zone.

Toners employed to form ordinary toner images and specified toner images are comprised of the same composition and comprise at least external lubricants. Said external lubricants are not particularly limited, and it is possible to employ various fine inorganic, organic particles and slipping agents.

Said control mechanism is assumed to function as follows. For example, by decreasing cleaning effects obtained by cleaning roller 21, employing cleaning blade 23, specified toner images are allowed to reach the cleaning zone. In order to decrease said cleaning effects obtained by cleaning roller 21, for example, when said specified toner image passes through the cleaning zone employing cleaning roller 21, it is possible to decrease said cleaning effects by decreasing or eliminating bias voltage which is applied to cleaning roller 21, employing said bias voltage applying means (hereinafter occasionally referred to as "roller effect decreasing function").

The toner image forming function in said control mechanism is considered to be achieved as follows. The operation of said image forming unit is controlled so that said specified toner image is formed at every specified frequency of image formation, namely, said specified toner image passes through the transfer zone until the recording material, which continuously follows said recording material, is supplied to said transfer zone, after recording materials involved in the specified image forming frequency passes through said transfer zone.

Further, at the time when copying operation is initiated as well as at the time when copying operation is terminated, the operation of said image forming unit may be controlled so as to form said specified toner image.

When said specified toner image is formed at every specified frequency of image formation, said specified toner image varies depending on the width or the length in the circumferential direction, or on the contact load and contact angle θ1. However, it is preferable to be set so that said specified image is formed at such a frequency as, for example, from once per 5 copies to once per 100 copies.

Specifically, as the width or the length in the circumferential direction increases, the frequency of said specified toner image formation is set so as to decrease, and as the contact load or contact angle θ1 of cleaning blade 23, with respect to photoreceptor 10, decreases, the frequency of specified toner image formation is set so as to also decreases.

Further, it is also possible to set the frequency of specified toner image formation based on total image formation frequency or a specified ambience. Specifically, it is set so that as the total image formation frequency increases, the frequency of the specified toner image formation increases. Further, when employed under an ambience of high temperature and high humidity (at least 30° C. and at least 80 percent relative humidity), high frequency of the specified toner image formation is set, while when employed under an ambience of low temperature and low humidity (no higher than 10° C. and no higher than 20 percent relative humidity), said frequency is set to be low.

Said image forming unit is comprised of charging unit 11, exposure unit 12, and development unit 13. During formation of said specified toner images, operation of at least one of three is controlled. Specifically, it is possible to employ a means in which charging to photoreceptor 10 employing charging unit 11 is temporarily suspended, and a so-called solid image is formed by allowing toner to adhere onto the entire surface of an uncharged image forming area, a means in which light is selectively irradiated onto the uniformly charged area, employing charging unit 11, in which said specified toner image is to be formed, and a means in which a solid image is formed in such a manner that by temporarily increasing a development bias applied to development sleeve 13A in development unit 13, toner is subjected to adhesion. Of these means, from the viewpoint of excellent controllability of the size of said specified toner images and image density, it is preferable that said specified toner image is formed employing the means described in aforesaid (2).

It is preferable that the area of the specified toner image to be formed on photoreceptor 10 is greater, in the lateral direction of photoreceptor 10 (being the rotating direction), than the image forming area formed by ordinary image forming processes. Further, it is preferable that said area is at least 90 percent of the cleaning area obtained employing cleaning blade 23.

Further, the length of photoreceptor 10 in the circumferential direction is preferably in the range of 0.1 to 30 mm. When said length is 0.1 mm or less, it is difficult to obtain sufficient effects to minimize blade curl-under as well as minute vibrations. On the other hand, when it exceeds 30 mm, insufficient cleaning may occur.

When the image forming apparatus, constituted as above, is employed, by removing the specified toner image formed on photoreceptor 10 employing cleaning blade 23, lubricating action is applied between cleaning blade 23 and photoreceptor 10, employing toner comprising external lubricants which are employed to constitute specified toner images. As a result, it is possible to retard an excessive increase in friction force applied to cleaning blade 23 so that it is possible to carry out stable production of high quality images over an extended period of time.

Further, since said specified toner image is formed on photoreceptor 10 so as to function as the lubricant for cleaning blade 23, it is possible to maintain desired cleaning effects by the blade. As a result, it is unnecessary to provide a lubricant supply means separately from cleaning unit 20, whereby it is possible to decrease the overall size of the cleaning unit.

By lowering or eliminating the bias voltage applied to cleaning roller 21, said roller effect decreasing effects are become evident. As a result, it is possible to assuredly supply a definite amount of toner to cleaning blade 23, whereby it is possible to assuredly minimize blade curl-under as well as minute vibrations.

Further, by forming said specified toner images at every specified image formation frequency, it is possible to achieve stable lubricating action at a definite interval with respect to cleaning blade 23, whereby it is possible to assuredly minimize the formation of curl-under as well as minute vibrations.

As noted in the image forming method of the present invention, in addition to mechanical cleaning obtained by employing cleaning blade 23, electrostatic cleaning obtained by employing cleaning roller 21 is practiced. As a result, without an increase in contact load of cleaning blade on photoreceptor 10, it is possible to exhibit stable and high cleaning performance over an extended period of time. Therefore, marked effects are exhibited by employing organic photoreceptors which have not been employed using the conventional cleaning unit, due to the fact that it is impossible to increase contact load of cleaning blade 23 and to obtain stable cleaning performance over an extended period of time.

The Photoreceptor employed in the invention will now be described.

First, photoreceptor 10 in FIG. 1(*a*) or 1(*b*), employed in the embodiment of the present invention will be detailed.

An area to which a toner is adhered, as well as a scraping force which is applied to remove a toner, greatly depend on the surface roughness of the photoreceptor.

Employed as the present photoreceptor is one which has a surface roughness Rz in the standard length of 15 mm of 0.1 to 2.5 $\mu$m.

As noted above, the surface of present photoreceptor is suitably roughened, namely has said surface roughness Rz. As a result, even when toner is not present between the present photoreceptor and the cleaning blade, close contact between them is prevented whereby blade curl-under due to an increase in friction force between them is minimized.

When said surface roughness Rz is less than 0.1 μm, friction force between the photoreceptor and the cleaning blade increases due to excessive flatness of the photoreceptor surface, whereby blade curl-under tends to occur.

When said surface roughness Rz is 2.5 μm or more, the photoreceptor surface is excessively roughened. As a result, insufficient toner removal occurs due to a decrease in the cleaning ability of the cleaning blade as well as an increase in the abrasion amount of said blade, whereby insufficient cleaning effect, shown by black streaks and white streaks tends to occur.

<<Surface Roughness of Photoreceptor: Method for Adjusting Ten-point Mean Roughness Rz to the Range of 0.1 to 2.54 μm>>

A method for adjusting the surface roughness of the photoreceptor to the desired value will now be described.

Effectively employed as a method for adjusting the surface roughness of the photoreceptor, that is, ten-point mean roughness Rz to the range of 0.1 to 2.5 μm, is one which suitably roughens the surface of the conductive support constituting said photoreceptor.

Employed mainly as materials of the conductive support employed in the embodiments of the present invention are metals such as aluminum, copper, brass, steel, and stainless steel, as well as plastic materials which are molded and machined to a belt shape or a drum shape. Of these, aluminum, due to its low cost and excellent machinability, is preferably employed. Cylindrical thin wall aluminum tubes, prepared commonly by extrusion molding or drawing molding, are frequently employed.

The roughened surface of the conductive support employed in the present embodiment is preferably from 0.1 to 2.5 μm in terms of ten-point mean surface roughness Rz, and is more preferably from 0.2 to 1.5 μm. It is possible to adjust the surface roughness by applying the interlayer and the photosensitive layer described below onto the support having said surface roughness.

As noted above, methods for roughening the surface of supports include a method which shaves the support surface employing cutting tools so as to achieve surface roughening, a sand blasting method in which minute particles are allowed to collide with the support surface, a machining method employing the ice particle washing apparatus described in Japanese Patent Publication Open to Public Inspection No. 4-204538, and a honing method described in Japanese Patent Publication Open to Public Inspection No. 8-15110. Further, listed are an anodic oxidation method, an alumite processing method, a buffing method, a method utilizing a laser method described in Japanese Patent Publication Open to Public Inspection No. 8-1502, and a roller burnishing method described in Japanese Patent Publication Open to Public Inspection No. 8-1510. However, surface roughening methods are not limited to these.

Further, considered as other methods to roughen the photoreceptor surface is a method in which fine 0.1 to 5 μm particles are added to the surface layer of the photoreceptor. For example, as described in Japanese Patent Publication Open to Public Inspection No. 8-248663, it is possible to adjust the roughness of the photoreceptor surface to said range in such a manner that fine inorganic particles, which have been subjected to a hydrophobic treatment, are dispersed and incorporated into the surface layer of the photoreceptor. As the method for rendering fine inorganic particles hydrophobic, methods may be employed in which treatment is carried out employing hydrophobicity resulting agents such as titanium coupling agents, silane coupling agents, and polymer fatty acids or metal salts thereof.

Definition of Surface Roughness Rz and its Measurement Method

The surface roughness Rz, as describes in the present embodiments, refers to ten-point mean roughness of length L of 15 mm, that is, the difference between the average height of the 5 highest peaks and the average depth of the 5 lowest valleys.

In the present embodiments, roughness Rz was determined employing a surface roughness meter (Surfcorder SE-30H, manufactured by Kosaka Kenkyusho Co.). However, other measurement devices may be employed as long as the same results are obtained within the prescribed error range.

The apparatus have preferably a pair of cleaning members.

Figure 7:
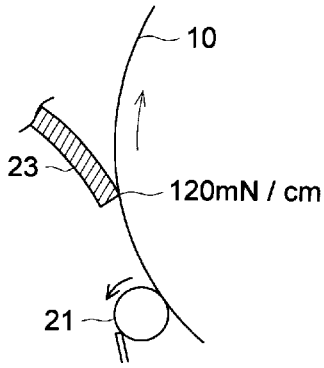
FIGS. 7(*a*) to 7(*f*) are each a view of a structure in which each cleaning member is paired.
Figure 7:
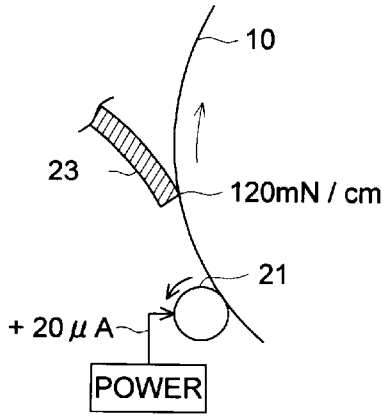
Figure 7:
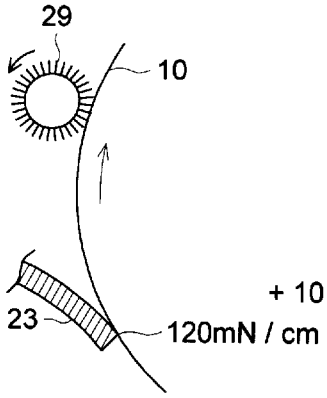
Figure 7:
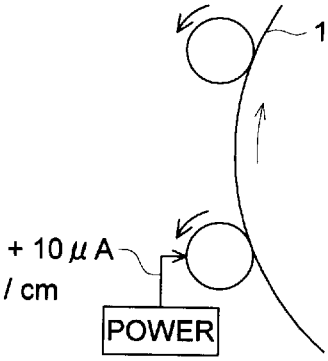
Figure 7:
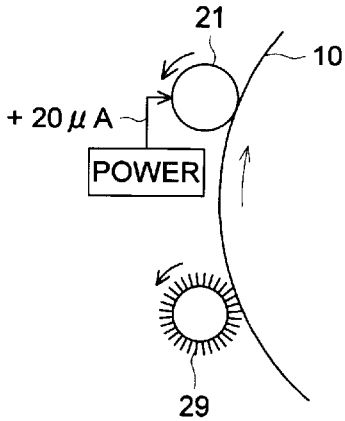
Figure 7:
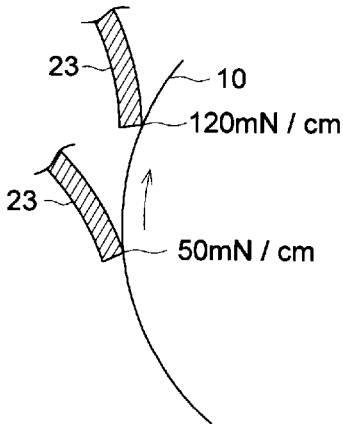

FIGS. 7(*a*) to 7(*f*) each is a view of a structure in which each cleaning member is paired.

As a practical problem, when a non-transferred image at the highest density (being formed during the patch formation for adjusting the image density or during jamming) is cleaned employing the first cleaning member, investigations were carried out to clarify the necessary removal amount of the toner of said image so that the residual toner on the photoreceptor was completely removed employing the additional second cleaning member.

As a result, it was discovered that when at least 50 percent by weight of the residual toner, adhered onto the photoreceptor, was removed by said first cleaning member, it was also possible to completely remove the toner of any non-transferred image. It was assumed that by allowing said first cleaning member to remove at least 50 percent by weight of the toner on the photoreceptor, toner particles near the lowest layer resulted in a decrease in the adhesion force to the photoreceptor. Namely, it was assumed that even though it was impossible to remove toner particles near the lowest layer, minute movement and charge removal due to mechanical vibration as well as electrostatic action resulted in a decrease in the strong adhesion force with the photoreceptor.

Accordingly, even for the same amount of adhered toner, the adhesion force onto the photoreceptor of toner in the toner layer, which has been subjected to removal employing said cleaning member, is very different from that in the toner layer, which has not been subjected to said removal. Thus it will be understood that the aforesaid results are obtainable.

In order to achieve effects to decrease said adhesion force, essential conditions are that as noted above, at least 50 percent by weight of toner particles forming the toner layer is removed. As the upper limit, 90 percent by weight or less is preferred. As constituted above, it becomes possible to completely remove all residual toner on the photoreceptor, even though the removing ability of the second cleaning member is not always high.

On the other hand, when the first cleaning member removes the toner at a ratio of less than 50 percent by weight, the action of the first cleaning member to the toner particles near the lowest layer becomes insufficient. As a result, even though the second cleaning member results in a high toner removal ratio, toner near the photoreceptor occasionally remains. When it is attempted to completely remove said remaining toner by increasing the force of the second cleaning member, the toner pressing force to the photoreceptor increases. As a result, filming as well as abrasion of the surface of the photoreceptor is caused.

When it is attempted to completely remove all residual toner particles including the lowest layer, employing only one cleaning member, said tendency is further enhanced. For example, when an elastic blade is employed as the cleaning member, a small pressing force to the photoreceptor results in insufficient cleaning, while an excessively large pressing force results in toner filming as well as abrasion on the surface of said image firming body. Further, even though there are optimal pressing conditions between them, their range is extremely narrow and varied due to various external factors. As a result, it is impossible to put them into practical use.

Further, when the system, as described above, is utilized in which a large load is applied to the cleaning member on the downstream side, any mechanical problems of the cleaning member results in delivery of a large amount of residual toner to image forming members (being a charging unit and development unit). This is not preferable from the aspect of stability of the entire image forming apparatus. Even in cases in which the above occurs, it is preferable that the amount of the residual toner, which will be carried further downstream from the cleaning unit be as little as possible.

Incidentally, the toner removal ratio, as described in the present invention, was calculated employing the formula described below, based on the weight ratio (weight after passing:weight prior to passing) of the adhered toner per unit area before and after cleaning one toner layer to 10 toner layers adhered onto the photoreceptor to be measured. The toner adhesion weight was obtained as follows. Toner on the photoreceptor was collected employing previously weighed adhesive tape of a definite area, and the resulting tape was weighed.

Toner removal ratio (in percent)=(weight after cleaning/weight of prior to cleaning)×100

The adhesion amount of residual toner prior to cleaning varies depending on toner particle diameter, but is from 0.8 to 1.2 mg/cm$^2$ at a toner particle diameter of 8.5 $\mu$m, and 0.4 to 0.7 mg/cm$^2$ at a toner particle diameter of 6.5 $\mu$m. However, these values vary to a large extent depending on the types of toner resins and incorporation or non-incorporation of magnetic materials.

Said cleaning unit comprises a first cleaning member and a second cleaning member downstream, and is structured so that at least 50 percent of the residual toner on the photoreceptor is removed employing the first cleaning member.

Toner Cleaning System Applicable to the Present Invention

Currently, there are several different types of toner cleaning systems. However, systems applicable to the present invention are not particularly limited, and any effective system may be employed. Representative systems include a blade cleaning system/a brush roller cleaning system. In addition, these applications as either the first cleaning member or the second cleaning member are not particularly limited. The most common system is that the roller is used as the first cleaning member, while the blade is used as the second cleaning member.

Blade Cleaning System

Installation of blade is such that the leading edge of said blade comes into pressure contact with an photoreceptor, being counter to its rotation (being a so-called counter directional pressure contact), and the angle between the tangential line of the photoreceptor drawn at the pressure contact section and the blade is suitably from 0 to 40 degrees on the blade passing surface.

When both first and second cleaning members are constituted employing said blade system, from the viewpoint of minimizing of curl-under, it is preferable that the load of the second cleaning member is less than that of the first one.

Elastic/Brush Roller Cleaning System

Said system is constituted in such a manner that elastic roller and brush roller 29 come into contact with the photoreceptor and the toner on said photoreceptor is mechanically removed.

In order to improve the contact state with the photoreceptor, in the case of the elastic roller of which surface is comprised of elastic materials, it is possible to employ those which are comprised of rubber materials, conventionally known in the art, such as silicone rubber and polyurethane, or foamed materials thereof, and further those in which the surface of the foamed materials is covered with resins.

On the other hand, in the case of said brush roller, employed as materials of the brush section may be fibers, conventionally known in the art, such as rayon, nylon, and vinylon.

From the viewpoint of minimizing of toner splitting, as well as minimizing abrasion of the surface of the photoreceptor, it is preferable that either said elastic roller or said brush roller moves in the same direction (being the driven rotation direction) as the photoreceptor in the contact section.

When moved to the opposite direction, in the case in which, for example, during insufficient transfer or jamming, there is particularly a large amount of toner on the surface of the image holding body, recovered toner is possibly spilt onto transfer material. From this point of view, when both rotation directions are set to be the same, operator attention will not be needed.

An photoreceptor and a roller (herein, referred to as an photoreceptor) need not be rotated at the same identical speed, and the resulting circumferential speed ratio is preferably from 0.5:1 to 2:1. When said ratio is less than 0.5, the resulting cleaning power decreases, while when it exceeds 2, in the case of interposing foreign matter, the surface of the photoreceptor is possibly damaged.

In order to remove recovered toner, a scraper or a flicker is frequently fitted with a practically employed elastic roller or brush roller.

Further, in order to enhance cleaning ability, it is possible to apply a bias voltage onto the elastic section or the brush section. By so doing, it is possible to preferably carry out cleaning employing electrical force. In said embodiment, a constant current power source unit is preferably employed which is constituted so that the output voltage is controlled, based the resistance between the elastic/brush roller and the photoreceptor so as to continually output constant electric current values.

The polarity of the applied voltage during said period is opposite that of the toner employed for visualization. Namely, when the toner is charged negatively, the electric current is subjected to controlling so that a positive bias voltage is applied to the cleaning roller. Since the voltage is applied utilizing a constant current power source, the roller surface, or the brush and the surface of the photoreceptor carry an electric potential difference so as to run a constant electric current. Since said electric potential difference is always kept constant corresponding to the electric potential on the photoreceptor, unevenness and insufficient cleaning, due to the electric potential level of the photoreceptor as well as the polarity, rarely occur, compared to the case employing a constant current power source. Further, since a marked large electric potential difference does not occur, discharge onto the photoreceptor also hardly occurs.

Further, cleaning properties, image quality, photoreceptor durability, and blade durability over an extended period of time are more effectively enhanced by preparing the surface layer of the electrophotographic photoreceptor employed in the present embodiments, comprising siloxane based resins having a cross-linked structure as the major component. Said surface layer comprised of said siloxane based resins, having a cross-linked structure as the major component, exhibits high surface hardness as well as excellent elasticity. As a result, the photoreceptor surface is minimally abraded by the cleaning blade, and in addition, the surface structure, prepared by applying the surface layer to the electrophotographic photoreceptor and subsequently drying the resultant coating, is maintained over an extended period of time, whereby consistent cleaning properties are maintained for an extended period of time.

It is possible to form a photoreceptor according to the embodiment of the invention comprising a surface layer containing said siloxane based resin having cross-linking structure mentioned above by a way described below.

The siloxane based resinous layer is formed by applying, onto a support, a coating composition prepared by employing organic silicon compounds represented by General Formula (1), described below, as the raw materials and subsequently drying said coated layer. These raw materials undergo hydrolysis in a hydrophilic solvent and subsequently result in a condensation reaction. Thus, they form condensation products (oligomers) of organic silicon compounds in a solvent. By applying these coating compositions onto a support and subsequently drying the resultant coated layer, it is possible to form a resinous layer comprising siloxane based resins forming a three-dimensional net structure.

General Formula (1)

$$(R)_n—Si—(X)_{4-n}$$

wherein R represents an organic group in which a carbon atom directly bonds to a silicon atom, X represents a hydroxyl group or a hydrolyzable group, and n represent an integer of 0 to 3.

In organic silicon compounds represented by General Formula (1), listed as organic groups represented by R, in which the carbon atom directly bonds to the silicon atom, are an alkyl group such as methyl, ethyl, propyl, butyl, and the like; an aryl group such as phenyl, tolyl, naphthyl, biphenyl, and the like; an epoxy containing group such as γ-glycidoxypropyl, β-(3,4-epoxycyclohexyl)ethyl, and the like; a (metha)acryloyl containing group such as γ-acryloxypropyl, and γ-methacryloxypropyl; a hydroxy containing group such as γ-hydroxypropyl, 2,3-dihydroxypropyloxypropyl, and the like; a vinyl containing group such as vinyl, propenyl, and the like; a mercapto containing group such as γ-mercaptopropyl, and the like; an amino containing group such as γ-aminopropyl, N-β (aminoethyl)-γ-aminopropyl and the like; a halogen containing group such as γ-chloropropyl, 1,1,1-trifluoropropyl, nonafluorohexyl, perfluorooctylethyl and the like; and others such as a nitro- or cyano-substituted alkyl group. Specifically preferred are alkyl groups such as methyl, ethyl, propyl, butyl, and the like. Further, listed as hydrolyzable groups represented by X are an alkoxy group such as methoxy, ethoxy, and the like, a halogen atom, and an acyloxy group. Specifically preferred are alkoxy groups having not more than 6 carbon atoms.

Further, organic silicon compounds represented by General Formula (1) may be employed individually or in combinations of two or more types. However, it is preferable to employ at least one type of organic silicon compounds represented by General Formula (1), in which n is 0 or 1.

Further, in the specific organic silicon compounds represented by General Formula (1), when n is at least 2, a plurality of R may be the same or different. In the same manner, when n is not more than 2, a plurality of X may be the same or different. Still further, when at least two types of organic silicon compounds represented by General Formula (1) are employed, R and X, in each compound, may be the same or different.

Said surface layer is preferably formed so that colloidal silica is incorporated into the composition comprising said organic silicon compounds or hydrolyzed condensation products thereof. The colloidal silica, as described herein, means silicon dioxide particles which are dispersed colloidally into a dispersion medium. Said colloidal silica may be added during any stage of preparation of the coating composition. Said colloidal silica may be added in the form of water based or alcohol based sol, and aerosol prepared in a gas phase may be dispersed directly into the coating composition.

In addition, metal oxides such as titania, alumina, and the like, may be added in the form of sol or a particle dispersion.

Colloidal silica and said tetrafunctional (n=0) or trifunctional (n=1) organic silicon compounds provide elasticity as well as rigidity with the resinous layer of the present invention through the formation of a bridge structure. As the ratio of bifunctional silicon compounds (n=2) increases, rubber elasticity as well as hydrophobicity increases. Unifunctional silicon compounds (n=3) undergo no polymerization but increase hydrophobicity upon reacting with residual SiOH groups which have not undergone reaction.

The surface layer is a preferably a resin layer which is comprised of siloxane based resins prepared utilizing condensation reaction of said organic silicon compounds or condensation products thereof with the compounds represented by General Formula (2) described below.

General Formula (2)

$$B—(R_1—ZH)_m$$

wherein B represents a univalent or multivalent group comprising structural units having charge transportability, $R_1$ represents a single bond or divalent alkylene group, Z represents an oxygen atom, a sulfur atom or NH, and m represents an integer of 1 to 4.

Further, compounds represented by the aforementioned General Formula (2) may be subjected to condensation reaction with the hydroxyl group on the colloidal silica surface and incorporated into said siloxane based resinous layer.

In the present invention, employed may be a composite siloxane based resinous layer prepared by adding other metal hydroxides (for example, hydrolyzed products of each alkoxide of aluminum, titanium, and zirconium) except for said colloidal silica.

B of General Formula (2) is a univalent group comprising a charge transportable compound structure. Comprising a charge transportable compound structure, as described herein, means that the compound structure obtained by excluding a $R_1$—ZH group in General Formula (2) possesses charge transportability or a compound represented by BH, which is obtained by substituting $R_1$—ZH in the aforementioned General Formula (2) with a hydrogen atom, possesses charge transportability.

In other definition, the charge transportable compound is a compound showing characteristics having drift mobility of electrons or holes, or in other words, a compound by which an electric current caused by charge transportation can be detected by a known method for detecting the charge transportation ability such as Time-Of-Flight method.

The composition ratio of the total weight (H) of the condensation product formed from said organic silicon compound, having a hydroxyl group or hydrolyzable group, and an organic silicon compound, having a hydroxyl group or a hydrolyzable group, to the composition of compound (I) represented by the aforementioned General Formula (2) is preferably between 100:3 and 50:100 in terms of the weight ratio, and is more preferably between 100:10 and 50:100.

In the present invention, further, colloidal silica or other metal oxides may be added. When colloidal silica or other metal oxides (J) are added, 1 to 30 weight parts of (J) is preferably employed with respect to 100 parts of said total weight (H) plus the weight of compound (I) component.

When a component, having said total weight (H), is employed within said range, the resin layer of the photoreceptor of the present invention exhibits high hardness as well as sufficient elasticity. The weight of component (J), shows similar characteristics as component (H). On the other hand a component, having said total weight (I), is employed within said range, it exhibits good electrophotographic characteristics such as sensitivity, residual potential and so on as well as high hardness of the resin layer.

When said siloxane based resinous layer for the surface layer is formed, in order to enhance condensation reaction, condensation catalysts are preferably employed. The condensation catalysts employed herein may be those which either catalytically act on condensation reaction or move the reaction equilibrium of the condensation reaction in the reaction proceeding direction.

Employed as specific condensation catalysts may be those such as acids, metal oxides, metal salts, alkyl aminosilane compounds, and the like, which have conventionally been employed in silicone hard coat materials. For example, listed may be alkali metal salts of organic carboxylic acids, nitrous acid, sulfurous acid, aluminic acid, carbonic acid, and thiocyanic acid; organic amine salts (tetramethylammonium hydroxide, tetramethylammonium acetate), tin organic acid salts (stannous octoate, dibutyl tin acetate, dibutyl tin dilaurate, dibutyl tin mercaptide, dibutyl tin thiocarboxylate, dibutyl tin maliate, and the like; and the like.

In General Formula (2), the group having the charge transportable compound structure represented by B, has a positive hole transport type and an electron transport type. Listed as positive hole transport type groups are groups having structural units such as oxazole, oxadiazole, thiazole, triazole, imidazole, imidazolone, imidazoline, bisimidazoline, styryl, hydrazone, benzidine, pyrazoline, triarylamine, oxazolone, benzothiazole, benzimidazole, quinazoline, benzofuran, acridine, phenazine, and the like, and groups derived from derivatives thereof. On the other hand, listed as electron transport type groups having structural units such as succinic anhydride, maleic anhydride, phthalic anhydride, pyromellitic anhydride, mellitic anhydride, tetracyanoethylene, tetracyanooxodimethane, nitrobenzene, dinitrobenzene, trinitrobenzene, tetranitrobenzene, nitrobenzonitrile, picryl chloride, quinonechloroimide, chrolanil, bromanil, benzoquinone, napthoquinone, diphenoquinone, tropoquinone, anthraquinone, 1-chloroanthraquinone, dinitroanthraquinone, 4-nitrobenzophenone, 4,4'-dinitrobenzophenone, 4-nitrobenzalmalondinitrile, α-cyano-β-(p-cyanophenyl)-2-(p-chlorophenyl)ethylene, 2,7-dinitrofluorenone, 2,4,7-trinitrofluorenone, 2,4,5,7-tetranitrofluorenone, 9-fluoronylidenedicyanomethylenemalonitrile, polynitro-9-fluoronylidenedicyanomethylenemalonitrile, picric acid, o-nitro-benzoic acid, p-nitro-benzoic acid, 3,5-dinitrobenzoic acid, perflurobenzoic acid, 5-nitrosalicylic acid, 3,5-dinitrosalysilic acid, phthalic acid, mellitic acid, and groups derived from derivatives thereof.

Representatives examples of compounds represented by General Formula (2) are described below.

Examples of compounds, in which Z represents an oxygen atom in General Formula (2), are listed below.

T-1

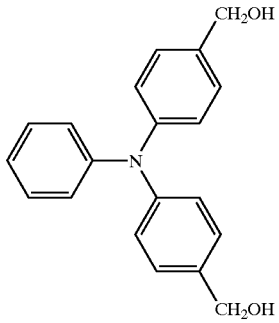

T-2

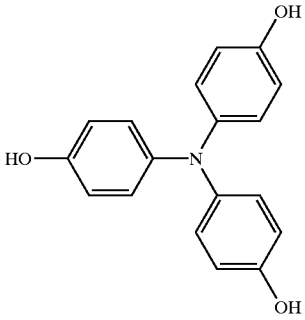

T-3

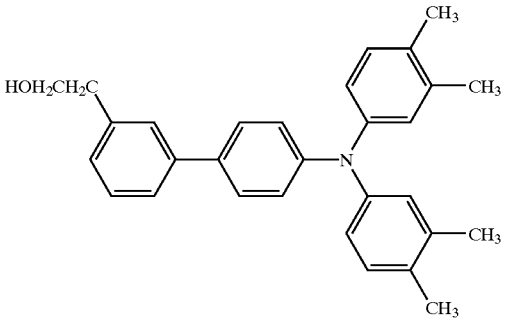

-continued
T-4
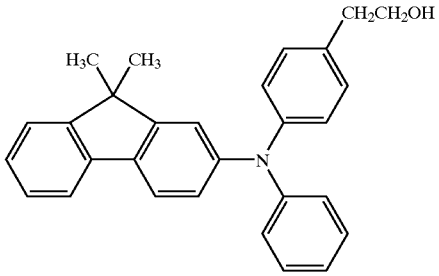
H-1
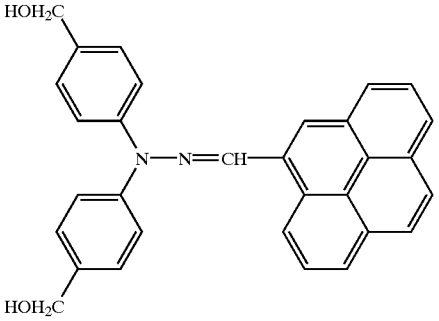
H-2
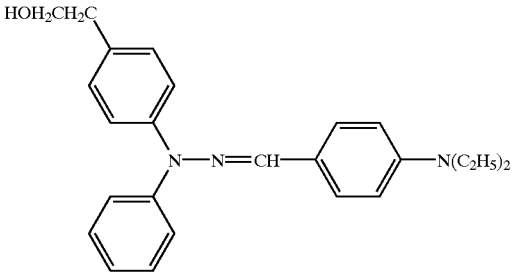
H-3
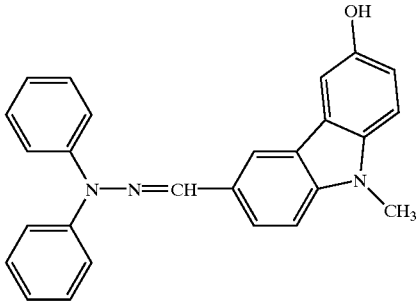
S-1
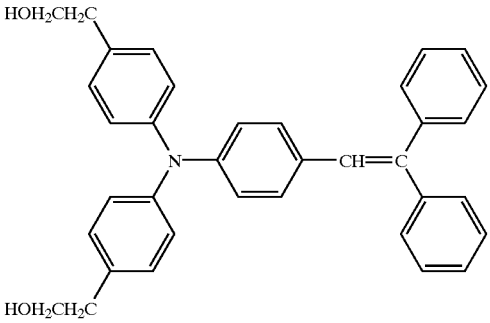
-continued
S-2
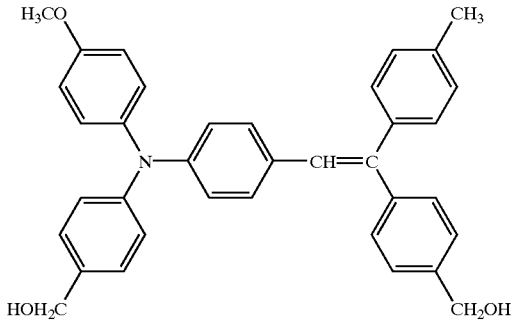
S-3
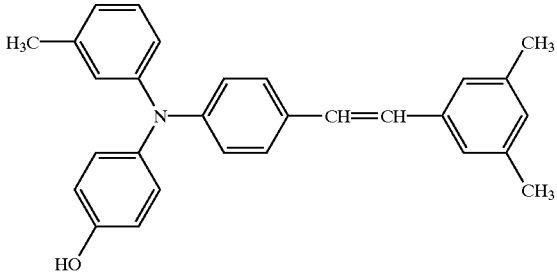
Be-1
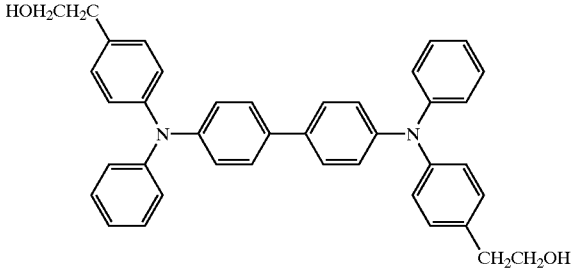
Be-2
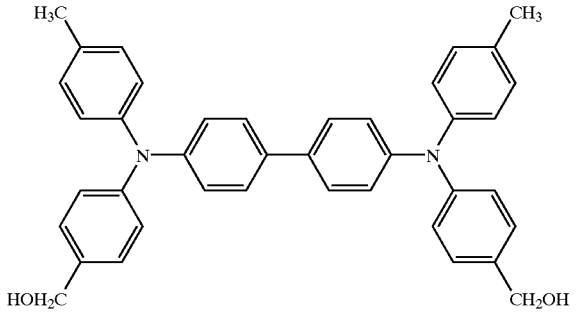
Bu-1
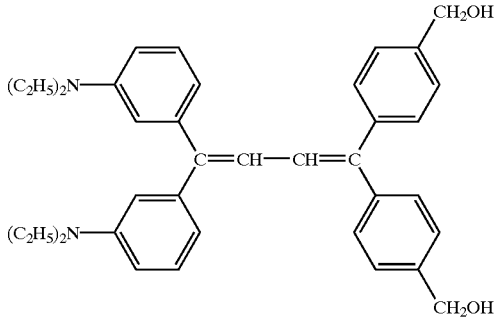

-continued
So-1
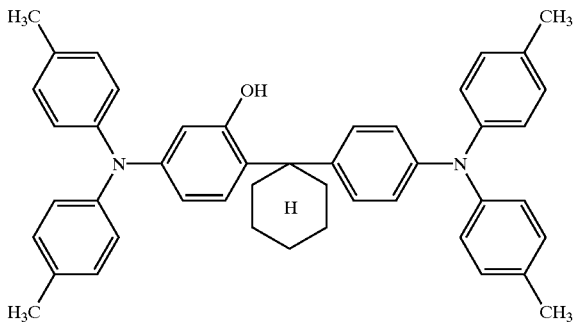
So-2
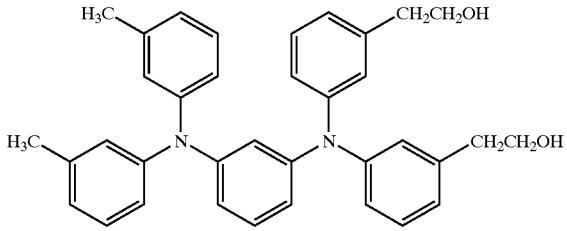
Next, examples of compounds, in which Z represents an NH group in General Formula (2), are listed below.
W-1
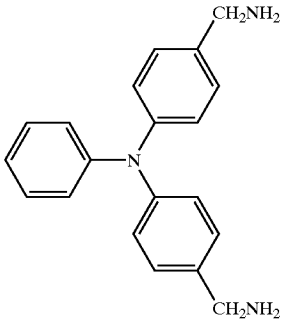
W-2
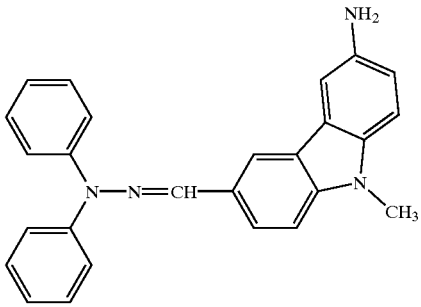
-continued
W-3
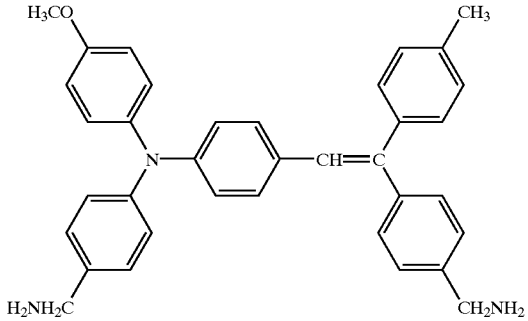
W-4
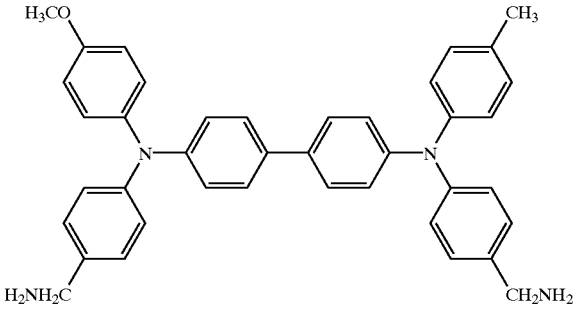
W-5
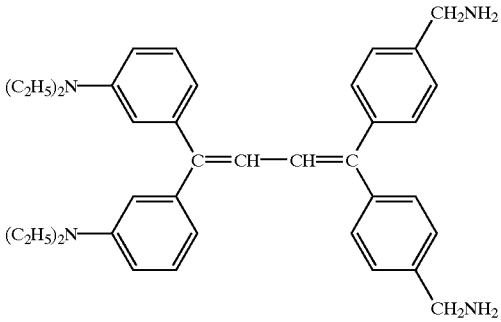
W-6
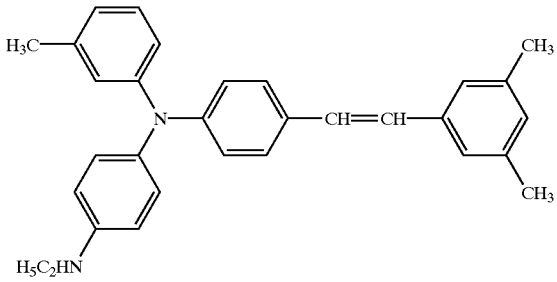
Next, examples of compounds, in which Z represents a mercapto group (SH) in General Formula (2), are listed below.

V-1

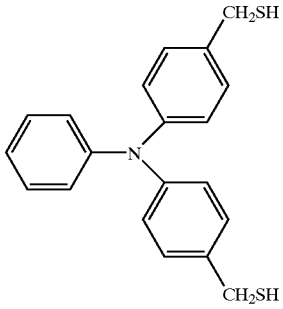

V-2

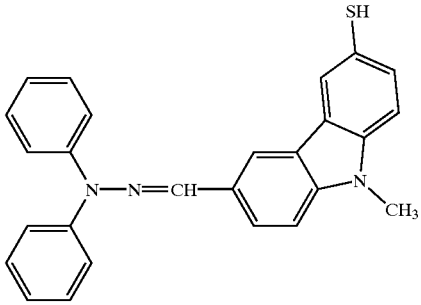

V-3

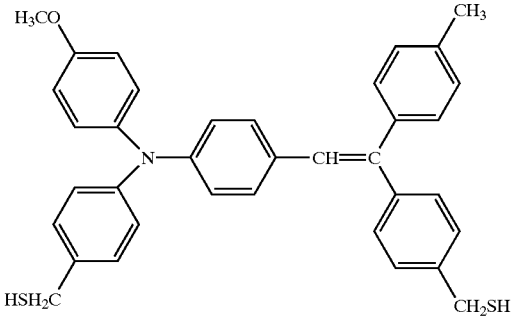

V-4

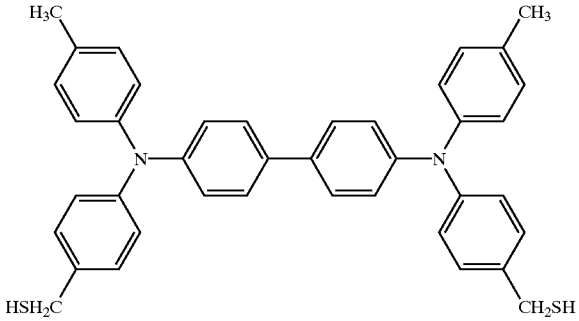

-continued

V-5

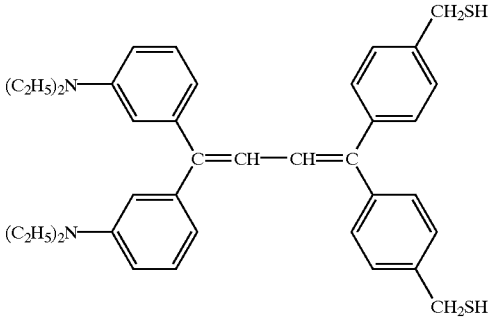

The layer configuration of the photoreceptor according to the invention is not restricted specifically. It is preferable that the photoreceptor comprises an electro-conductive support having under coat (ULC), and thereon, photosensitive layer having separated functions of charge generation layer (CGL) and charge transport layer (CTL) in this order and further thereon a resin layer coat according to the present invention in the negative charge photoreceptor. The order of the charge generation layer and the charge transport layer among the negative charge photoreceptor mentioned above is preferably reversed in the positive charge photoreceptor. A photosensitive (charge generation and charge transport) layer may be provided on a electro-conductive support having an under coat layer (UCL), and further the resin layer according to the invention is coated.

The resin layer may have function of the photosensitive layer as well. In this instance, the resin layer may work as the charge generation layer or the charge transport layer in the separated function photoreceptor mentioned above. Or, the photosensitive layer of single layer photoreceptor may be composed of the resin layer.

The resin layer of the photoreceptor is used as a surface layer so as to make good use of characteristics of the resin layer. In the other embodiment a surface layer may be provided. on the resin layer so as to improve lubricating characteristics at the time of starting of the image formation when the photoreceptor is installed in an electrophotographic image forming apparatus.

Employed in the charge generating layer (CGL), the charge transfer layer (CTL) and the photosensitive layer of single layer photoreceptor may be those commonly known in the art. For example, employed as the charge generating materials (CGM) may be phthalocyanine pigments, azo pigments, perylene pigments, azulenium pigments, and the like. For example, employed as charge transfer materials (CTM) triphenylamine derivatives, hydrazone compounds, styryl compounds, benzidine compounds, butadiene compounds, and the like. These charge transport materials are commonly dissolved in appropriate binder resins and are then subjected to film formation.

In the layers in which the resin layer of the invention is not employed as the photosensitive layers, i.,e., the charge generating layer (CGL), the charge transfer layer (CTL) and the photosensitive layer of single layer photoreceptor resins employed for the binder are listed as, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors such as poly-N-vinylcarbazole.

The ratio of binder resins to charge generating materials is preferably between 20 and 600 weight parts per 100 weight parts of the binder resins. The ratio of binder resins to charge transport materials is preferably between 10 and 200 weight parts per 100 weight parts of the binder resins.

The thickness of the charge generating layer is preferably between 0.01 and 2 $\mu$m. The thickness of the charge transport layer is preferably between 10 and 40 $\mu$m. And the thickness of the resin layer provided on the photosensitive layers is preferably from 0.1 to 5 $\mu$m.

In order to improve adhesion between the electrically conductive support and said photosensitive layer or to minimize charge injection from said support, provided is the under-coat layer (UCL) employed on the photoreceptor of the present invention between said support and said photosensitive layer. Listed as materials of said under-coat layer are polyamide resins, vinyl chloride resins, vinyl acetate resins, and copolymer resins comprising at least two repeating units of these resins. The other example includes hardened metal resin compound which is obtained by thermally hardening organic metal resin such as silane coupling agent or titanium coupling agent. The thickness of the interlayer comprised of these resins is preferably between 0.01 and 10 $\mu$m.

The antioxidants may be incorporated in the surface layer so as to prevent generation of fogging or image blur at high temperature and high humidity.

The antioxidants, as described herein, means materials, as representative ones, which minimize or retard the action of oxygen under conditions of light, heat, discharging, and the like, with respect to auto-oxidation occurring materials which exist in the electrophotographic photoreceptor or the surface thereof. Specifically, a group of such compounds described below is listed.

(1) Radical Chain Inhibitors
- Phenol based antioxidants (hindered phenol based)
- Amine based antioxidants (hindered amine based, diallyldiamine based, diallylamine based)
- Hydroquinone based antioxidants (hindered phenol based)

(2) Peroxide Decomposing Agents
- Sulfur based antioxidants (thioethers)
- Phosphoric acid based antioxidants (phosphorous acid esters)

Of said antioxidants, preferred are radical chain inhibitors included in (1). Specifically hindered phenol based or hindered amine base antioxidants are preferable. Further two or more types may be employed in combinations. For example, hindered phenol based antioxidants listed in (1) are preferably employed together with thioether antioxidants listed in (2). Further, antioxidants may be employed in which structural units of said antioxidants such as hindered phenol structural units and hindered amine structural units are incorporated into molecules.

Of said antioxidants, hindered phenol based and hindered amine based antioxidants are specifically effective for minimizing the formation of background stain as well as image blurring under high temperature and high humidity.

The content of hindered phenol based or hindered amine based antioxidants in a resinous layer is preferably between 0.01 to 20 percent by weight. When the content is less than 0.01 weight percent, neither background stain nor image blurring is minimized under high temperature and high humidity. On the other hand, when the content is no less than 20 percent by weight, charge transportability on the resinous layer is degraded, the residual potential tends to increase, and further, the layer strength decreases.

Further, if desired, said antioxidants may be incorporated into a charge generating layer in the lower layer, a charge transport layer, an interlayer, or the like. The added amount of said antioxidants to these layers is preferably between 0.01 and 20 percent by weight with respect to each layer.

The hindered phenols as described herein means compounds having a branched alkyl group in the ortho position relative to the hydroxyl group of a phenol compound and derivatives thereof. (However, the hydroxyl group may be modified to an alkoxy group.)

The hindered amines are compounds having an organic bulky group neighboring to nitrogen atom. An example of the bulky group is branched alkyl group, preferable example of which is t-butyl group. The preferable examples of the compounds having organic group are those represented by the following structural formula:

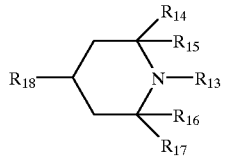

wherein $R_{13}$ represents a hydrogen atom or a univalent organic group, $R_{14}$, $R_{15}$, $R_{16}$, and $R_{17}$ each represents an alkyl group, and $R_{18}$ represents a hydrogen atom, a hydroxyl group, or a univalent organic group. Listed as antioxidants having a partial hindered phenol structure are compounds described in Japanese Patent Publication Open to Public Inspection No. 1-118137 (on pages 7 to 14).

Listed as antioxidants having a partial hindered amine structure are compounds described in Japanese Patent Publication Open to Public Inspection No. 1-118138 (on pages 7 to 9).

Phosphoric acid compounds include, for example, compounds represented by General Formula RO—P(OR)—OR. Listed as representative compounds are those described below. Incidentally, in said General Formula, R represents a hydrogen atom, and a substituted or unsubstituted group of any of alkyl group, an alkenyl group or an aryl group.

Organic sulfur compounds include, for example, compounds represented by General Formula R—S—R. Listed as representative compounds are those described below. Incidentally, in general formula, R represents a hydrogen atom, substituted or unsubstituted group of any of an alkyl group, an alkenyl group or an aryl group.

Compounds examples of representative antioxidants are listed below.
1-1
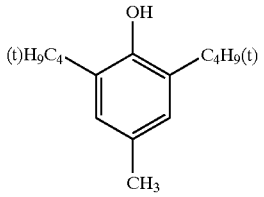
1-2
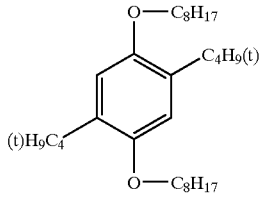
1-3
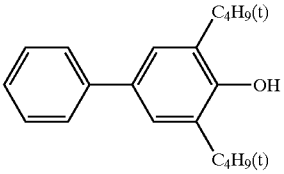
1-4
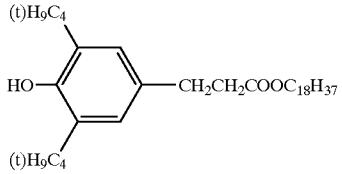
1-5
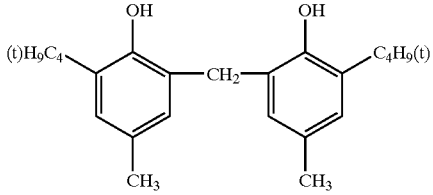
1-6
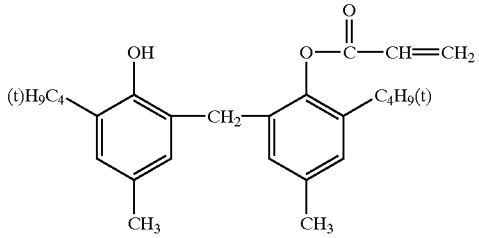
1-7
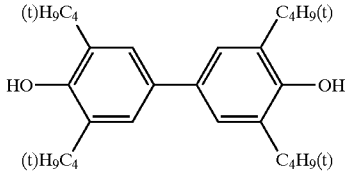
1-8
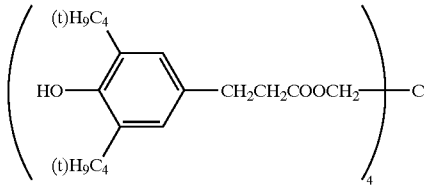
1-9
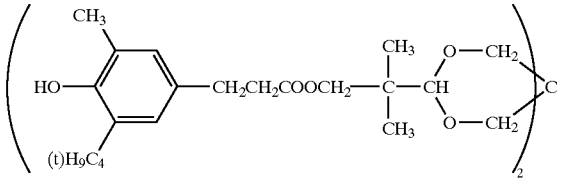
1-10
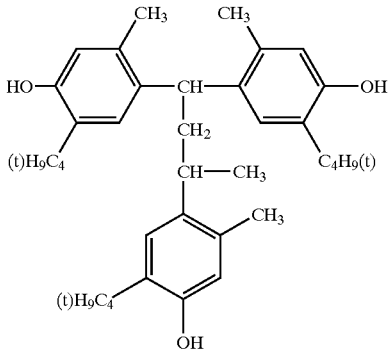

-continued 2-1

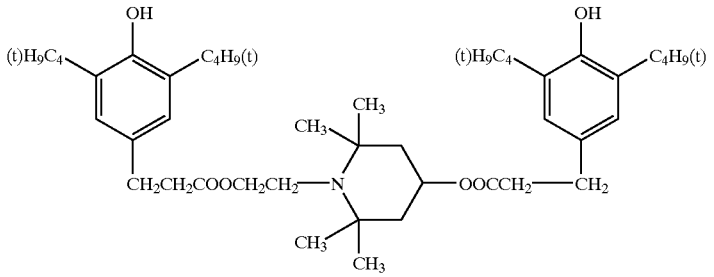

2-2

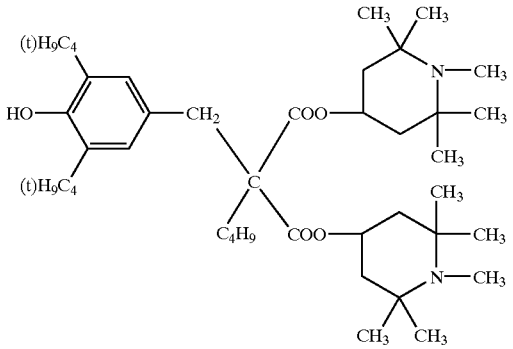

2-3

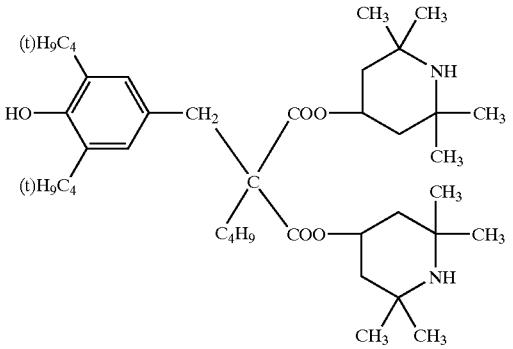

2-4

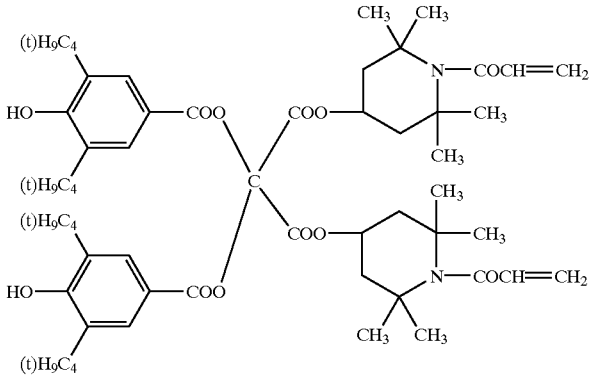

2-5

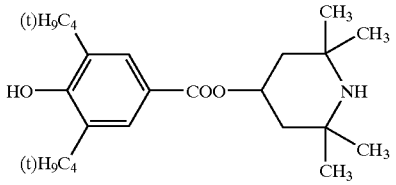

2-6

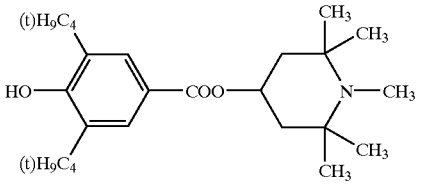

2-7

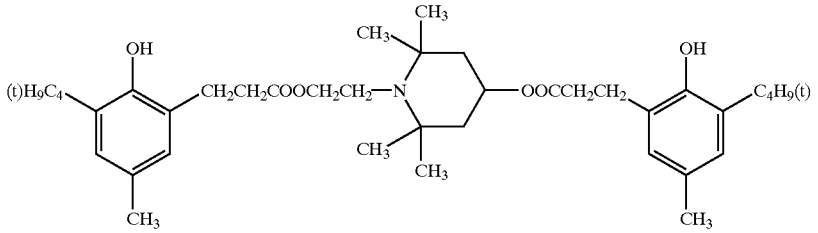

Examples of antioxidant available on the market include the followings.

Hindered phenol type antioxidant: Ilganox 1076, Ilganox 1010, Ilganox 1098, Ilganox 245, Ilganox 1330, Ilganox 3114, and 3,5-di-t-butyl-4-hydroxybiphenyl.

Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63.

Thioether type antioxidant: Sumirizer TPS and Sumirizer TP-D.

Phosophite type antioxidant: Mark 2112, Mark PEP-8, Mark PEP-24G, Mark PEP-36, Mark 329K and Mark HP-10.

The siloxane based resin containing layer of the present invention is formed by dissolving siloxane based resinous composition in common solvents and coating the resultant composition onto a support. Employed as said solvents are alcohols and derivatives thereof such as methanol, ethanol, propanol, butanol, methyl cellosolve, ethyl cellosolve, and the like; ketones such as methyl ethyl ketone, acetone, and the like; esters such as ethyl acetate, butyl acetate, and the like; and the like.

The siloxane based resinous layer of the present invention is preferably dried by heating. Cross linking and hardening reaction in said siloxane based resin layer is enhanced by said heating. Said crosslinking and hardening conditions vary depending on the types of solvents used as well as the presence and absence of catalysts, but heating in the range of about 60 to about 160° C. is preferably carried out over 10 minutes to 5 hours, and heating in the range of 90 to 120° C. is more preferably carried out over 30 minutes to 2 hours.

The outermost layer of the photoreceptor employed in the present embodiment, preferably has a contact angle to water of at least 90 degrees and an upper limit of 180 degrees.

By employing a photoreceptor having such a highly releasable surface, abrasion of the cleaning roller is minimized, and a uniform electric field is formed between said photoreceptor and the said cleaning roller. As a result, insufficient of residual toner is prevented. Further, since the photoreceptor and the cleaning roller move at a stabilized speed ratio at their contact area, an electric field is consistently formed, whereby excellent cleaning is uniformly carried out. Further, the phenomena in which the toner transferred to the cleaning roller is re-transferred to the photoreceptor is minimized, whereby excellent cleaning is carried out.

The present photoreceptor, which is an electrophotographic photoreceptor having a highly releasable surface, is prepared by uniformly dispersing, for example, fluorine based resin powder onto its surface layer. Employed as specific examples of said fluorine based resin powders are polymers of tetrafluoroethylene, hexafluoropropylene, trifluoroethylene, chlorotrifluoroethylene, vinylidene fluoride, vinyl fluoride, perfluoroalkyl vinyl ether, and copolymers thereof. Said fluorine based resinous powders having a particle diameter in the range of 0.01 to 5 μm are usable and those having a molecular weight in the range of 3,000 to 5,000,000 may be usable.

Said fluorine based resinous powder is dispersed as a photosensitive layer composition along with binder resins. Employed as dispersion methods are sand mills, ball mills, roll mills, homogenizers, nanomizers, paint shakers, and ultrasonic wave generators. During dispersion, fluorine based surface active agents, graft polymers, and coupling agents may be employed as auxiliary agents.

The content ratio of said fluorine based resinous powder is preferably from 2 to 70 percent by weight in the outermost layer of the photoreceptor, and is more preferably from 4 to 55 percent by weight. When the content ratio is less than 2 percent by weight, the surface energy is not sufficiently decreased, while when the content ratio exceeds 70 percent by weight, the strength of the surface layer is decreased.

Listed as binder resins which are employed to disperse fluorine based resinous powder are polyester, polyurethane, polyallylate, polyethylene, polystyrene, polybutadiene, polycarbonate, polyamide, polypropylene, polyimide, polyamidoimide, polysulfone, polyallyl ether, polyacetal, nylon, phenol resins, acrylic resins, silicone resins, epoxy resins, urea resins, allyl resins, alkyd resins, and butyral resins. Further, reactive epoxy, acrylic, or methacrylic monomers and oligomers may be mixed, and subsequently hardened, and the resulting products may be employed.

The photosensitive layer of the present photoreceptor is comprised of a single layer or a laminated layer structure. In the case of said laminated layer, a charge generating layer which forms light carriers and a charge transport layer which allows carriers to migrate, are laminated. The surface layer may be comprised of either a charge generating layer or a charge transport layer.

The allowed thickness of the photosensitive layer comprised of a single layer is preferably from 5 to 100 μm, and is more preferably from 10 to 60 μm. The content ratio of charge generating materials or charge transport materials is preferably from 20 to 80 percent by weight, and is more preferably from 30 to 70 percent by weight. In a layer-laminated photoreceptor, the thickness of the charge generating layer is preferably from 0.001 to 6 μm, and is more preferably from 0.01 to 2 μm. The content ratio of charge generating materials is preferably from 10 to 100 percent by weight, and is more preferably from 40 to 100 percent by weight. The thickness of the charge transport layer is preferably from 5 to 100 μm, and is more preferably 10 to 60 μm. The content ratio of the charge transport materials is preferably from 20 to 80 percent by weight, and is more preferably from 30 to 70 percent by weight.

Listed as charge generating materials employed in the present embodiments are phthalocyanine pigments, polycyclic quinone pigments, azo pigments, perylene pigments, indigo pigments, quinacridone pigments, azulenium salt dyes, squalirium dyes, cyanine dyes, pyrylium dyes, thiopyrylium dyes, xanthene dyes, quinoneimine dyes, triphenylmetharie dyes, styryl dyes, selenium, selenium-tellurium, amorphous silicon, and cadmium sulfide.

Listed as charge transport materials employed in the present embodiments are pyrene compounds, carbazole compounds, hydrazone compounds, N,N-dialkylaniline compounds, diphenylamine compounds, triphenylamine compounds, triphenylmethane compounds, pyrazoline compounds, styryl compounds, and stilbene compounds.

In the present photoreceptor, a protective layer may be laminated onto the photosensitive layer. The thickness of said protective layer is preferably from 0.01 to 20 μm, and is more preferably from 0.1 to 10 μm. Into said protective layer may be incorporated said charge generating materials or charge transport materials, metals and oxides thereof, nitrides, salts, and further conductive materials such as carbon.

Listed as binder resins employed in said protective layer are polyester, polyurethane, polyallylate, polyethylene, polystyrene, polybutadiene, polycarbonate, polyamide, polypropylene, polyimide, polyamidoimide, polysulfone, polyallyl ether, polyacetal, nylon, phenol resins, acrylic resins, silicone resins, epoxy resins, urea resins, allyl resins, alkyd resins, and butyral resins. Further, reactive epoxy, acrylic, or methacrylic monomers and oligomers are mixed, and subsequently hardened, and the resulting products may be employed.

Solvents, which are employed to disperse or dissolve charge generating materials as well as charge transport materials, include hydrocarbons such as toluene, xylene, and the like; halogenated hydrocarbons such as methylene chloride, 1,2-dichloroethane, and the like; ketones such as methyl ethyl ketone, cyclohexanone, and the like; esters such as ethyl acetate, butyl acetate, and the like; alcohols and derivatives thereof such as methanol, ethanol, methyl cellosolve, ethyl cellosolve, and the like; ethers such as tetrahydrofuran, 1,4-dioxane, 1,3-dioxolane, and the like;

amines such as pyridine, diethylamine, and the like; amides such as N,N-dimethylformamide, and the like; fatty acids and phenols; sulfur and phosphorous compounds such as carbon disulfide, trimethyl phosphate, and the like; and the like. These may be employed individually or in combination.

Next, employed as coating methods to produce the electrophotographic photoreceptor of the present invention may be a dip coating method, a spray coating method, a circular amount regulating type coating method, and the like. In order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in Japanese Patent Publication Open to Public Inspection Nos. 3-90250 and 3-269238, while the above-mentioned circular amount control type coating is detailed in, for example, Japanese Patent Publication Open to Public Inspection No. 58-189061.

Employed as conductive supports used in the present photoreceptor may be metals such as iron, copper, nickel, aluminum, titanium, tin, antimony, indium, lead, zinc, gold and silver, or alloys and oxides thereof, carbon, and conductive resins. The shape of said conductive supports includes cylinders, belts, and sheets. Further, said conductive materials are occasionally molded and machined, but may be coated as coating compositions or subjected to evaporation coating.

A sublayer may be provided between the conductive support and the photosensitive layer. Said sublayer is mainly comprised of binder resins, but may comprise said conductive materials or acceptors. Listed as binder resins to form said sublayer are polyester, polyurethane, polyallylate, polyethylene, polystyrene, polybutadiene, polycarbonate, polyamide, polypropylene, polyimide, polyamidoimide, polysulfone, polyallyl ether, polyacetal, nylon, phenol resins, acrylic resins, silicone resins, epoxy resins, urea resins, allyl resins, alkyd resins, and butyral resins.

The present photoreceptor is produced employing methods such as evaporation and coating. Employed for coating are a bar coater, a knife coater, an attritor, a spray, dip coating, electrostatic coating, and powder coating.

Toner employed in the invention is described.

Further, the present invention also exhibits markedly desired effects when toner comprised of small-sized particles and polymerization toner comprised of nearly spherical particles, prepared by employing a polymerization method, are employed which tend to result in insufficient cleaning such as insufficient residual toner removal. Specifically, even when toner comprised of particles having a volume average particle diameter of no more than 8.5 $\mu$m, and further of no more than 6.5 $\mu$m, polymerization toner comprised of nearly spherical particles, and toner comprised of particles having a volume average particle diameter in the range of 2 to 32 $\mu$m, in which CV value of said toner particles is no more than 20 percent, are employed, an appropriate removal electric field acts on these toners employing cleaning roller 30. As a result, it is possible to assuredly remove said toner from photoreceptor 10. "CV value", as described herein, represents the range of the toner particle size distribution and is obtained based on the formula described below.

$$\text{CV value}=(\text{standard deviation of particle diameter/arithmetic diameter})\times 100 \text{ (in percent)}$$

The toner is preferably composed of specific particles having uniform shape. A high quality image having excellent developability and fine line reproduction ability can be obtained for long term by employing toner comprises at least 65 percent of toner particles in the range of shape coefficient of 1.0 to 1.6.

Further, it is extremely suitable to be employed in the invention since sharp distribution of charge amount can be obtained and, therefore, stain caused by toner scattering inside of the apparatus is strained and stability for long term is excellent.

The shape coefficient of the toner of the invention is an index of roundness of the toner particles and is defined by the formula.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In order to obtain this shape coefficient, toner particles are magnified 2000 times employing a scanning type electron microscope and their image is photographed. Subsequently, employing the resulting electron microscopic image, the photographic image is analyzed, using "SCANNING IMAGE ANALYSER" (manufactured by JEOL Ltd.). At the time, a figure, which is statistically meaningful, for example 100 toner particles, is employed so that shape coefficient is calculated by the formula described above.

The ratio of toner particles having a shape coefficient of 1.0 to 1.6 is at least 70 percent by number. And further, the ratio of toner particles having a shape coefficient of 1.2 to 1.6 is at least 65 percent, more preferably 70 percent or more by number.

When the content of toner having shape coefficient of 1.0 to 1.6 is 65 number % or more, frictional charging characteristics by the developer carrying device is improved to be homogeneous, and accumulation of toner charged in access is prevented, cleaning of toner particles on photoreceptor is carried out effectively. Further, the generation of fine toner particles is inhibited since the toner particles are hard to be cracked, and therefore, the is easily carried out by employing cleaning device according to the present invention in combination.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

Of the preparation methods, the polymerized toner method is preferable since it is simple as well as convenient as a toner production method, the surface uniformity is excellent compared to pulverized toner, and the like.

In order to uniformly control said shape coefficient of toner with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by Toa Iyodenshi Co.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The diameter of the toner particles of the present invention is preferably between 3 and 8 $\mu$m in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 $\mu$m, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The diameter of toner particles is designated as D (in $\mu$m). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class. By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

Measurement Conditions (1) Aperture: 100 $\mu$m (2) Method for preparing samples: an appropriate amount of a surface active agent (a neutral detergent) is added while stirring in 50 to 100 ml of an electrolyte, ISOTON R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

The toner of the present invention may be prepared employing a method in which fine polymerization particles are prepared employing a suspension polymerization method, or a method in which monomers undergo emulsion polymerization in a solution to which an emulsified composition of necessary additives is added, and thereafter, association is carried out by adding organic solvents, coagulants, and the like. During said association, listed are methods in which preparation is carried out in such a manner that a dispersion of releasing agents, colorants, and the like, which are required to constitute a toner, is mixed and association is carried out, emulsion polymerization is carried out upon dispersing toner components such as releasing agents, colorants, and the like into monomers, and the like. Said association as described herein denotes that a plurality of resin particles and colorant particles are allowed to fusing with each other.

In the invention, the "aqueous medium" is a medium containing at least 50% by weight of water.

Namely, various constitution materials such as colorants, and if desired, releasing agents, charge control agents, further polymerization initiators, and the like are incorporated into polymerizable monomers, and each of the constitution materials is dissolved in or dispersed into the polymerizable monomers employing a homogenizer, a sand mill, a sand grinder, an ultrasonic homogenizer, and the like. The polymerizable monomers, into which these various constitution materials are dissolved or dispersed, are dispersed into an aqueous medium comprising a dispersion stabilizer so as to form oil droplets having a desired size. Thereafter, the resulting dispersion is transferred to a reaction apparatus having a stirring mechanism composed of stirring blades described below, and undergoes polymerization reaction upon raising its temperature. After completing the reaction, the dispersion stabilizer is removed, filtered, washed, and further dried to prepare the toner of the present invention.

The toner according to the invention can be also obtained by salting-off/coagulating resin particles prepared by the emulsion polymerization or the mini-emulsion polymerization. For example, the methods described in JP O.P.I. Nos. 5-265252, 6-329947 and 9-15904 are applicable.

The toner of the present invention is prepared employing a method in which a plurality of dispersion particles of the constitution materials comprised of resin particles, colorants and the like, or of fine particles comprised of resins, colorants, and the like, are associated, in which in particular, after dispersing these into water employing an emulsifier, the resulting dispersion is salted out by adding a coagulant in an amount of more than the critical coagulation concentration; at the same time, while forming fused particles upon heating the formed polymer at least to the glass transition temperature of the polymer, so as to fuse with each other, the particle diameter is increased; when growing the particle diameter to a desired diameter, a large amount of water is added to halt the growth of the diameter; the particle surface is then smoothed through heating and stirring, whereby the shape is controlled; and the resulting particles are heat dried in a fluid state while suspended in a water comprising state. Further, herein, organic solvents which are infinitely soluble in water may be added at the same time, together with a coagulating agent.

Employed polymerizable monomers to constitute a resin include styrenes or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, and the like; acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; acrylic acid or methacrylic acid derivatives such as acrylonitrile, methacrylonitrile, acrylamide and the like. These vinyl based monomers may be employed individually or in combination.

Further, still more preferably employed as polymerizable monomers, which constitute a resin, are those having an ionic dissociation group in combination, which are, for example, have a substituent such as a carboxyl group, a sulfonic acid group, a phosphoric acid group, and the like as a group constituting the substituent. Listed as specific examples are acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamide-2-methylpropanesulfonic acid, acidphosoxyethyl methacrylate, 3-chloro-2-acidphophoxypropyl-methacrylate, and the like.

Furthermore, the resin may be modified so as to have a cross-linking structure, employing multifunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

These polymerizable monomers may undergo polymerization employing a radical polymerization.initiator. In such cases, oil-soluble polymerization initiators may be employed in a suspension polymerization method. Such oil-soluble polymerization initiators include azo based or diazo based polymerization initiators such as 2,2'-azobis-(2,4-dimethylvaleronitrile, 2,2'-azobisisobutyronitrile, 1,1'-azobis(cyclohexane-1-carbonitrile), 2,2-azobis-4-methoxy-2,4-dimethylvaleronitrile, azobisisobutyronitrile, and the like; and peroxide based polymerization initiators and polymer initiators having a peroxide in the side chain such as benzoyl peroxide, methyl ethyl ketone peroxide, disopropylperoxycarbonate, cumenehydroperoxide, t-butylhydroperoxide, di-t-butylperoxide, dicumylperoxide, 2,4-dichlorobenzoyloxide, lauroylperoxide, 2,2-bis-(4,4-t-butylperoxycyclohexyl)propane, tris-(t-butylperoxy) triazine, and the like.

Further, when the emulsion polymerization method is employed, water-soluble radical polymerization initiators may be employed. Water-soluble polymerization initiators include persulfates such as potassium persulfate, ammonium persulfate, and the like, azobisaminodipropane acetic acid salts, azobiscyanovaleric acid and salts thereof, hydrogen peroxide, and the like.

Listed as dispersion stabilizers may be tricalcium phosphate, magnesium phosphate, zinc phosphate, aluminum phosphate, calcium carbonate, magnesium sulfate, calcium hydroxide, magnesium hydroxide, aluminum hydroxide, calcium metasilicate, calcium sulfate, barium sulfate, bentonite, silica, alumina, and the like. Further, also employed as dispersion stabilizers may be those which are generally employed as surface active agents such as polyvinyl alcohol, gelatin, methyl cellulose, sodium dodecybenzenesulfonate, ethylene oxide adducts, higher alcohol sodium sulfate, and the like.

Preferred as excellent resins in the present invention are those having a glass transition point of 20 to 90° C., as well as a softening point of 80 to 220° C. The glass transition point is a value measured by a differential calorimetric method, while the softening point can be measured by an elevated type flow tester. Further, these resins preferably have a number average molecular weight (Mn) of 1,000 to 100,000, as well as a weight average molecular weight (Mw) of 2,000 to 1,000,000, which are measured by gel permeation chromatography. Further, as a molecular weight distribution, the Mw/Mn is preferably between 1.5 and 100, and is most preferably between 1.8 and 70.

The employed coagulating agents are not particularly limited, however those selected from metal salts are more suitable. Specific examples include salts of univalent metals such as alkali metals, for example, sodium, potassium, lithium and the like; alkali earth metal salts of divalent metals such as calcium, magnesium, and the like; salts of divalent metals such as manganese, copper, and the like; and salts of trivalent metals such as iron, aluminum, and the like. Listed as specific salts can be sodium chloride, potassium chloride, lithium chloride, calcium chloride, zinc chloride, copper sulfate, magnesium sulfate, manganese sulfate, and the like. These may be employed in combination.

These coagulants are preferably added in an amount exceeding the critical coagulation concentration. The critical coagulation concentration as described herein is an index on the stability of an aqueous dispersion, and concentration at which coagulation is formed by the addition of a coagulant. The critical coagulation concentration varies greatly depending on the emulsified components and dispersing agents themselves. For example, the critical coagulation concentration is described in Seizo Okamoto, et al. "Kobunshi Kagaku (Polymer Chemistry)", edited by Nihon Kobunshi Gakkai, whereby detailed critical coagulation concentration data can be obtained. Furthermore, as another method, ζ (zeta) potentials of a specified particle dispersion are measured upon adding a desired salt to the particle dispersion, while changing the salt concentration, and said salt concentration which varies the ζ potential can be obtained as the critical coagulation concentration.

The added amount of the coagulant of the present invention is acceptable if it exceeds the critical coagulation concentration. However, the addition amount is preferably at least 1.2 times of the critical coagulation concentration, and is more preferably at least 1.5 times.

A solvent which is infinitely soluble denotes a solvent which is infinitely soluble in water and as such solvents, those which do not dissolve the resin formed in the present invention are selected. Specifically, cited are alcohols such as methanol, ethanol, propanol, isopropanol, t-butanol, methoxyethanol, butoxyethanol, and the like, nitrites such as acetonitrile, and ethers such as dioxane. In particular, ethanol, propanol and isopropanol are preferred.

The added amount of such solvents which are infinitely soluble is preferably between 1 and 100 percent by volume of the polymer containing dispersion to which the coagulant is added.

Further, in order to make all particles of a uniform shape, after preparing colored particles and filtering them, the resulting slurry, in which water is present in an amount of at least 10 percent by weight of the particles, is preferably subjected to fluidized drying. At the time, those which comprise a polar group in the polymer are particularly preferred. As the reason, it is assumed that since existing water somewhat exhibits swelling effect for the polymer comprising the polar group, making particles of a uniform shape tends to be particularly easily carried out.

The toner of the present invention comprises at least a resin and a colorant, but may as well comprise a releasing agent which works as a fixing property improving agent, a charge control agent, and the like. Further, external additives comprised of fine inorganic particles, fine organic particles, and the like may be added to toner particles which are mainly comprised of the above-mentioned resin and colorant.

Optionally employed as colorants, which are employed in the toner of the present invention, may be carbon blacks, magnetic materials, dyes, pigments, and the like. Employed as said carbon blacks are channel black, furnace black, acetylene black, thermal black, lamp black, and the like. Employed as magnetic materials may be ferromagnetic metals such as iron, nickel, cobalt, and the like, as well as alloys which do not comprise ferromagnetic metals and are subjected to thermal treatment to exhibit ferromagnetism, such types of alloys being called Heusler alloys, being for example, manganese-copper-aluminum, manganese-copper-tin and the like, and also chromium dioxide, and the like.

Employed as dyes can be C.I. Solvent Red 1, Solvent Red 49, Solvent Red 52, Solvent Red 58, Solvent Red 63, Solvent Red 111, and Solvent Red 122, C.I. Solvent Yellow 19, Solvent Yellow 44, Solvent Yellow 77, Solvent Yellow 79, Solvent Yellow 81, Solvent Yellow 82, Solvent Yellow 93, Solvent Yellow 98, Solvent Yellow 103, Solvent Yellow 104, Solvent Yellow 112, and Solvent Yellow 162; C.I. Solvent Blue 25, Solvent Blue 36, Solvent Blue 60, Solvent Blue 70, Solvent Blue 93, and Solvent Blue 95, and the like. Furthermore, these mixtures may be employed. Employed as pigments may be C.I. Pigment Red 5, Pigment Red 48:1, Pigment Red 53:1, Pigment Red 57:1, Pigment Red 122, Pigment Red 139, Pigment Red 144, Pigment Red 149, Pigment Red 166, Pigment Red 177, Pigment Red 178, and Pigment Red 222; C.I. Pigment Orange 31, and Pigment Orange 43; C.I. Pigment Yellow 14, Pigment Yellow 17, Pigment Yellow 93, Pigment Yellow 94, and Pigment Yellow 138; and C.I. Pigment Green 7; and C.I. Pigment Blue 15:3, and Pigment Blue 60; and the like. These mixtures may also be employed. The average primary-particle diameter varies depending on type, generally, however it is preferably between about 10 and about 200 nm.

The colorants may be added by a methods, in which colorants are added during which polymer particles prepared by an emulsion polymerization method are coagulated by adding a coagulant and the polymer is tinted; during polymerizing of said monomers, a colorant is added and the resulting mixture is polymerized to form tinted particles; and the like. Further, when the colorant is added during polymer preparation, it is preferably subjected to surface treatment employing a coupling agent and the like, which is employed so that radical polymerization is not hindered.

Further, added as fixing property enhancing agents may be low molecular weight polypropylene (having a number average molecular weight of 1,500 to 9,000) or low molecular weight polyethylene.

Charge control agents may also be employed, which are known in the art, and can be dispersed into water. Specifically listed are Nigrosine based dyes, metal salts of naphthenic acid or higher fatty acids, alkoxylated amines, quaternary ammonium salts, azo based metal complexes, salicylic acid metal salts or metal complexes thereof, and such. Further, these charge control agents and fixing property enhancing agents are preferably in a dispersed state, and the number average primary particle diameter is adjusted from about 10 to about 500 nm.

In a suspension polymerization method in which a composition, prepared by dispersing or dissolving toner constitution components such as a colorant and the like in polymerizable monomers, is suspended in a water based medium, and then undergoes polymerization to obtain the toner, the shape of toner particles may be controlled by controlling the flow of the medium in a reaction vessel in which the reaction is carried out. Namely, when many toner particles having a shape coefficient of at least 1.2 are formed, the flow in the reaction vessel is regulated to a turbulent one; polymerization proceeds; and when oil droplets suspended in the water based medium are gradually polymerized and oil droplets become soft particles, particle union is accelerated due to collisions of particles resulting in particles which are not stable in shape. Further, when spherical toner particles having a shape coefficient of not more than 1.2 are formed, the flow of the medium in said reaction vessel is regulated to a laminar flow to result in spherical particles upon minimal collisions between particles. Employing such methods, it is possible to control the toner shape distribution within the range specified by the present invention.

In the suspension polymerization, said turbulent flow may be generated employing specified stirring blades, and the shape may be readily controlled.

On the other hand, for a toner prepared by a polymerization method in which resin particles are associated or fused in an aqueous medium, it is possible to optionally vary the shape distribution as well as the shape of the particles by controlling the flow of a medium and the temperature distribution in the reaction vessel during the fusing stage, and further by controlling the heating temperature, the rotational frequency while stirring, and the time during the shape controlling process, after fusing.

Regarding the toner prepared by the polymerization method in which resin particles are associated or fused, it is possible to prepare a toner, having specific shape coefficient and the uniform shape distribution described in the present invention, by controlling the temperature, the rotation frequency and the time during the fusing process and shape controlling process, employing stirring blades as well as a stirring vessel which is capable of making the flow in the reaction vessel a laminar flow and the interior temperature distribution uniform. As the reason, it is assumed that when fusing is carried out in the location in which the laminar flow is generated, particles (associated or coagulated particles) while undergoing coagulation and fusing are not subjected to strong stress, and in the laminar flow in which the flow rate is accelerated, the temperature distribution in the stirring vessel is uniform, and as a result, the shape distribution of fused particles becomes uniform. Further, the fused particles are gradually varied to spherical particles by heating and stirring in the subsequent shape controlling process, and the shape of toner particles may thus be optionally controlled.

Blades and a stirring vessel, which are employed to prepare a toner employing the polymerization method in which resin particles are associated or fused, may be employed which are similar to those which are employed to generate a laminar flow in the above-mentioned suspension polymerization method. The stirring blades are preferably constituted at several levels in such a manner that the upper stirring blade is arranged so as to make an advanced crossed axes angle a in the rotational direction with respect to the lower stirring blade in the same manner as the case of the stirring blades which are employed for the above-mentioned suspension polymerization method.

Furthermore, the toner of the present invention may be advantageously employed when combined with external additives of fine particles, such as fine inorganic particles and fine organic particles. As the reason for such combining, it is assumed that burying and releasing of external additives may be effectively minimized, and its effect is markedly exhibited.

Preferably employed as such fine inorganic particles are inorganic oxide particles such as silica, titania, alumina, and the like. These fine inorganic particles are preferably subjected to hydrophobic treatment employing silan coupling agents, titanium coupling agents, and the like. The degree of the hydrophobic treatment is not particularly limited, however the degree is preferably between 40 and 95 measured as methanol wettability. The methanol wettability as described herein means the evaluation of wettability for methanol. In this method, 0.2 g of fine inorganic particles is weighed and added to 50 ml of distilled water placed in a 200 ml beaker. Methanol is slowly added dropwise while slowly stirring from a burette of which top is immersed in the solution until entire fine organic particles are wet. The degree of hydrophobicity is calculated from the formula given below:

$$\text{Degree of hydrophobicity}=a/(a+50)\times 100$$

wherein "a" (in ml) represents the amount of methanol required for making fine inorganic particles perfectly wet.

The added amount of said external additives is between 0.1 and 5.0 percent by weight of the toner, and is preferably between 0.5 and 4.0 percent by weight. As external additives, various materials may be employed in combination.

The toner according to the invention may be employed for a two-component developer, non-magnetic single component developer or magnetic single component developer, and is employed for the two-component developer most suitably.

A coated carrier composed of styrene-acryl resin, fluorinated acryl resin or silicon resin coated on iron powder, ferrite core or magnetite core is preferably employed as a carrier when the toner for developing static latent image according to the invention is employed in the two-component developer.

Further, even in the case in which a reversal development system is employed which has resulted in marked problems such as insufficient cleaning, when used in the conventional cleaning unit, the present invention is effectively employed since desired cleaning effects are assured.

The preferable embodiments of the invention are described.

1. An image forming apparatus, described above, wherein said toner employed for image visualization comprises at least 65 percent of toner particles in the range of shape coefficient of 1.0 to 1.6.
2. An image forming apparatus, described above, wherein said toner employed for visualization has a number average particle diameter in the range of 3 to 8 $\mu$m.
3. An image forming apparatus, described above, wherein said toner employed for visualization is comprised of toner particles which are formed by polymerizing a polymerizable monomer in a water based medium.
4. An image forming apparatus, described above, wherein toner particles are formed by coalescing toner particles which have been formed by polymerizing a polymerizable monomer in a water based medium.
5. In an image forming method comprising a development process which visualizes a latent image formed on an photoreceptor, employing a toner, and a cleaning process which removes any residual toner on said photoreceptor after transferring a toner image on said photoreceptor onto a transfer material, an image forming method wherein said cleaning process comprises two cleaning members consisting of a first cleaning member and a second cleaning member upstream along the conveyance direction of said photoreceptor, and at least 50 percent of the residual toner is removed by said first cleaning member and any residual toner is removed by said second cleaning member.

EXAMPLES

Specific examples of the present invention will now be described.

Example 1-1

According to the constitution of the image forming apparatus shown in FIG. 1(*a*), the photoreceptor, development unit, the toner, the cleaning roller, and the cleaning blade were set as described below.

(1) Photoreceptor

Employed as photoreceptor 10, was a drum-shaped organic photoreceptor which was prepared by forming a 25 $\mu$m thick photosensitive layer comprised of polycarbonate comprising phthalocyanine pigments on the circumferential surface of a drum-shaped aluminum base body. The friction coefficient between the surface of photoreceptor (10) and the used cleaning blade was 1.2

(2) Development Unit

Employed as development unit 13 was a unit fitted with rotionally-driven development sleeve 13A at a linear speed of 370 mm/minute, to which a bias voltage having the same polarity as the surface potential of photoreceptor 10 was applied so that reversal development was carried out employing a two-component developer.

The toner constituting said two-component developer was comprised of toner particles having a volume average particle diameter of 6.5 $\mu$m and a negative polarity, prepared by employing an emulsion polymerization.

(3) Cleaning Roller

Employed as cleaning roller 21 was a roller having a surface resistance of $10^4$ Ωcm, comprised of conductive foamed urethane.

Said cleaning roller 21 was rotationally driven so as to move the contact portion with photoreceptor 10 in the same direction as said photoreceptor 10, and the linear speed ratio Vr/Vp of the linear speed Vr of cleaning roller 21 to the linear speed Vp of photoreceptor 10 was set at 1.

(4) Cleaning Blade

Employed as cleaning blade 23 was a blade comprised of urethane rubber, having a repulsion elasticity modulus of 50 percent (at 25° C.), a JIS A Hardness of 70 degrees, a thickness of 2.00 mm, a free length of 10 mm, and a width of 324 mm.

Further, cleaning blade 23 was arranged so that contact angle θ1 and fulcrum angle θ2 were 23 degrees and 20 degrees, respectively (θ1>θ2). Pressing means 27 was set to result in a contact load of 20 g/cm to photoreceptor 10, employing a 350 g weight.

Under the above conditions, surface potential Vh of the unexposed area of photoreceptor 10 was set at −750 V and surface potential V1 of the exposed area of photoreceptor 10 was set at −100 V. Further, a −600 V development bias was applied to development sleeve 13A.

Further, by applying +20 μA to cleaning roller 21 employing bias voltage applying means 22 compromised of a constant current power source, said cleaning roller 21 was charged so that the surface potential reached +600 V.

Employing the image forming apparatus as above, practical imaging tests were carried out via printing 200,000 sheets, and blade curl-under as well as minute vibrations were evaluated. In said practical imaging test, printing of the 1st to the 100,000th sheet was carried out at high temperature and high humidity (at 30° C. and 80 percent relative humidity), printing of the 100,001st to the 150,000th sheet at normal temperature and normal humidity (20° C. and 50 percent relative humidity) and printing of the 150,001st to the 200,000th sheet was carried out at low temperature and low humidity (10° C. and 20 percent relative humidity). Table 1-1 lists the results.

Comparative Examples 1-1 through 1-3

Practical imaging tests were carried out in the same manner as Example 1-1, except that contact conditions of cleaning blade 23 to photoreceptor 10 were varied according to Table 1-1 below. Table 1-1 shows the results.

TABLE 1-1

| | Contact Angle θ1 | Fulcrum θ2 | Image Staining: Blade Curl-Under | Image Staining: Minute Vibrations | Remarks |
|---|---|---|---|---|---|
| Example 1-1 | 23° | 20° | good to the 200,000th sheet | good to 200,000th sheet sheet | good to the 200,000th |
| Comparative Example 1-1 | 20° | 23° | occurred at about the 120,000th sheet | continually occurred after the 100,000th sheet | the test was terminated at the 120,000th sheet |
| Comparative Example 1-2 | 0° | −5° | — | — | the test was terminated at the 10,000th sheet |

TABLE 1-1-continued

| | Contact Angle θ1 | Fulcrum θ2 | Image Staining: Blade Curl-Under | Image Staining: Minute Vibrations | Remarks |
|---|---|---|---|---|---|
| Comparative Example 1-3 | 35° | 32° | occurred at about the 140,000th sheet | continually occurred after the 120,000th sheet | the test was terminated at the 140,000th sheet |

As noted, it was confirmed that when the image forming apparatus of the present invention according to Example 1-1 was employed, it was possible to form high quality images over an extended period of time without effects of ambience.

Example 1-2

An image forming apparatus was constituted in the same manner as Example 1-1 except that cleaning blade 23 was disposed so as to form contact angle θ1 of 10 degrees and fulcrum angle θ2 of 12 degrees (θ1<θ2), and a control mechanism to carry out a specified toner image forming process was provided. In the resultant image forming apparatus, by controlling the action of exposure unit 12, employing said control mechanism, said specified toner image having a width of 320 mm and circumferential direction length of 1 mm was formed and when said specified toner image passed through the cleaning zone employing cleaning roller 21, the roller effect decreasing function which eliminated the bias voltage applied to cleaning roller 21 was simultaneously allowed to function. Further, it was set so that said specified toner image was formed at the beginning of the practical imaging test, thereafter was adjusted based on the total number of copied sheets and the atmospheric ambience so that said specified toner images were formed at the frequency shown in the table below, and also formed at the completion of the practical imaging test.

Employing said image forming apparatus, practical imaging was carried out via printing 200,000 sheets, and the presence and absence of blade curl-under and image staining was evaluated. Table 1-3 shows the results.

In said practical imaging test, printing of the 1st to the 100,000th sheet was carried out at high temperature and high humidity (at 30° C. and 80 percent relative humidity), printing of the 100,001st to the 150,000th sheet at normal temperature and normal humidity (20° C. and 50 percent relative humidity) and printing of 150,001st to 200,000th sheet was carried out at low temperature and low humidity (10° C. and 20 percent relative humidity).

Example 1-4

A practical imaging test was carried out in the same manner as Example 1-2, except that the specified toner image forming function and the roller effect decreasing function in the control mechanism were not completely operated. Table 1-3 shows the results.

Comparative Example 1-5

Practical imaging tests were carried out in the same manner as Example 1-2, except that the roller effect decreasing function was not allowed to operate. Table 1-3 shows the results.

TABLE 1-2

| Operation Ambience | Total Number of Copy Sheets | Frequency of Specified Toner Image Formation |
|---|---|---|
| Ambience at High Temperature and High Humidity | 1 to 100,000 sheets | once per 5 sheets |
| Ambience at Normal Temperature and Normal Humidity | 100,001 to 150,000 sheets | once per 50 sheets |
| Ambience at Low Temperature and Low Humidity | 150,001 to 200,000 sheets | once per 50 sheets |

TABLE 1-3

| | Operation of Specified Toner Image Forming Function | Operation of Roller Effect Decreasing Function | Evaluation |
|---|---|---|---|
| Example 1-2 | used | used | good to the 200,000th sheet |
| Comparative Example 1-4 | not used | not used | blade curl-under occurred at about the 30,000th sheet and the test was terminated |
| Comparative Example 1-5 | used | not used | blade curl-under occurred at about the 80,000th sheet and the test was terminated |

As noted, it was confirmed that the image forming apparatus of the present invention according to Example 1-2 was capable of carrying out stable production of high quality images irrespective of ambient effects, over an extended period of time. Further, since the specified toner image was formed at the completion of the practical imaging test, it was capable of sufficiently exhibiting cleaning effects employing the cleaning blade, even in use after the completion of the test.

In the foregoing, the embodiments of the present invention were described.

(1) The frequency of the specified toner image formation may be set based on, for example, time employed for image formation.

(2) The roller effect decreasing function in said control mechanism may be controlled so that the magnitude of the bias voltage applied to the cleaning roller is smaller than common cleaning process.

(3) Toner employed in the present invention may be employed in either a one-component developer or a two-component developer. Further, said toner may be employed as either a magnetic toner or a non-magnetic toner.

Further, the development system of latent images is not limited to the reversal development method.

In the image forming apparatus of the present invention, in addition to electrostatic cleaning obtained by employing the cleaning roller, mechanical cleaning employing a cleaning blade is carried out. As a result, highly effective cleaning is exhibited, and it is possible to assuredly remove residual toner. Furthermore, the position of rotationally driven center axis O is set so that the state of the cleaning blade satisfies the specified conditions. As a result, the load, which is applied to the leading edge of the cleaning blade while the photoreceptor is rotationally driven, acts so as to rotate the cleaning blade in the direction to allow the cleaning blade to separate from the surface of the photoreceptor, utilizing rotationally driven center axis O as the center. Therefore, it is possible to minimize the formation of blade curl-under as well as minute vibrations. At the same time, it is possible to obtain desired residual toner removing ability. Consequently, it is possible to carry out stable production of high quality images over an extended period of time.

Further, in the image forming apparatus in the present invention, by allowing the cleaning blade to remove toner images for maintaining blade effects, which are formed on the photoreceptor, lubricating action is effected between the cleaning blade and the photoreceptor, employing toner comprising lubricants as the external agent which constitutes toner images for maintaining said blade effects. As a result, it is possible to retard friction force acted on the leading edge of the cleaning blade to become excessive and to minimize the formation of blade curl-under as well as minute vibrations. Accordingly, it is possible to carry out stable production of high quality images over an extended period of time.

Example 2-1

According to the constitution of the image forming apparatus shown in FIG. 1(*b*), the photoreceptor, the development unit, the toner, the cleaning roller, and the cleaning blade were installed as described below.

(1) Photoreceptor

Employed as photoreceptor 10, was a drum-shaped organic photoreceptor which was prepared by forming a 25 $\mu$m thick photosensitive layer comprised of polycarbonate comprising phthalocyanine pigments on the circumferential surface of a drum-shaped aluminum base body.

(2) Charging Unit

As charging unit 11 was a scorotron charging unit. The effective charging area W3 of said charging unit was 318 mm.

(3) Development Unit

Employed as development unit 13 was a unit fitted with rotationally driven development sleeve 13A, to which a bias voltage having the same polarity as the surface potential of photoreceptor 10 was applied so that reversal development was carried out employing a two-component developer.

The toner constituting said two-component developer was comprised of toner particles having a volume average particle diameter of 6.5 $\mu$m, prepared employing an emulsion polymerization and had a negative polarity.

(4) Cleaning Roller

Employed as cleaning roller 21 was a roller having a surface resistance of $10^4$ Ωcm, comprised of conductive foamed urethane. The effective cleaning area W1 of said cleaning roller 21 was 320 nm.

Said cleaning roller 21 was rotationally driven so as to move the contact portion with photoreceptor 10 in the same direction as said photoreceptor 10, and the linear speed ratio Vr/Vp of the linear speed Vr of cleaning roller 21 to the linear speed Vp of photoreceptor 10 was set at 1.1.

(5) Cleaning Blade

Employed as cleaning blade 23 was a blade comprised of urethane rubber, having a JIS A Hardness of 70 degrees, a thickness of 2.00 mm, and a free length of 10 mm.

Further, contact angle e and contact load to photoreceptor 10 were set at 10 degrees and 20 g/cm, respectively.

(6) Other

Employed as transfer unit 14 was a corona discharge unit having effective transfer area W3 of 300 mm.

Under the above conditions, surface potential Vh of the unexposed area of photoreceptor 10 was set at −750 V and surface potential V1 of the exposed area of photoreceptor 10 was set at −100 V. Further, of −600 V development bias was applied to development sleeve 13A.

Further, by applying +20 $\mu$A to cleaning roller 21 employing bias voltage applying means 22, compromised of a constant current power source, said cleaning roller 21 was charged so that the surface potential reached +600 V.

Employing the image forming apparatus as above, practical imaging tests were carried out by printing the 200,000 sheets, and interior apparatus staining as well as insufficient cleaning was evaluated. In said practical imaging test, printing of the 1st to the 100,000th sheet was carried out at normal temperature and normal humidity (20° C. and 50 percent relative humidity) and printing of the 100,001st to the 200,000th sheet was carried out at high temperature and high humidity (at 30° C. and 80 percent relative humidity). Table 2-1 shows the results.

Comparative Examples 2-1 through 2-3

Practical imaging was carried out in the same manner as Example 2-1, except that W1, W2, and W3 were varied based on Table 2-1. Table 2-1 shows the results.

TABLE 2-1

| | W1 (in mm) | W2 (in mm) | W3 (in mm) | Interior Apparatus Staining | Insuffi-cient Cleaning | Remarks |
|---|---|---|---|---|---|---|
| Example 2-1 | 320 | 300 | 318 | good to the 200,000th sheet | good to the 200,000th sheet | good to the 200,000th copy |
| Comparative Example 2-1 | 300 | 320 | 268 | occurred at about the 50,000th sheet | occurred at about the 100,000th sheet | the test was terminated at the 100,000th copy due to insufficient cleaning |
| Comparative Example 2-2 | 320 | 300 | 268 | occurred around the 100,000th sheet | occurred at about the 80,000th sheet | great interior apparatus staining |
| Comparative Example 2-3 | 320 | 330 | 318 | occurred at about the 160,000th sheet | good to the 200,000th sheet | great interior apparatus staining |

As noted above, it was confirmed that the image forming apparatus of the present invention, employed in Example 2-1, resulted in no interior apparatus staining and was capable of producing high quality images over an extended period of time. Contrary to this, it was confirmed that the image forming apparatuses employed in Comparative Examples 2-1 through 2-3 were not commercially viable because all resulted in interior apparatus staining, and the apparatuses employed in Comparative Examples 2-1 and 2-2 resulted in belt-shaped insufficient cleaning.

Example 2-2

An image forming apparatus was constituted in the same manner as Example 2-1, except that cleaning roller 30 was employed in which insulated part 32 beyond both ends of conductive part 31 corresponding to effective charging area W3 of charging unit 11 was formed to be 10 mm for each end, and effective charging area W3 of charging unit 11 was set at 302 mm. Employing said apparatus, practical imaging tests, in which 200,000 sheets were printed, were carried out under conditions described below and interior apparatus staining as well as insufficient cleaning was evaluated. As a result, it was confirmed that said apparatus resulted in neither interior apparatus staining nor insufficient cleaning and produced high quality images over an extended period of time.

Said imaging tests were carried out at the ambient conditions described below:

from the first to the 100,000th sheet at normal temperature and normal humidity (20° C. and 50 percent relative humidity); from the 100,001st to the 150,000th sheet at low temperature and low humidity (10° C. and 20 percent relative humidity); from the 150,001st to the 200,000th sheet at high temperature and high humidity (30° C. and 80 percent relative humidity).

The embodiments of the present invention were described above. However, the present invention is not limited to the aforesaid embodiments.

(1) Said charging unit may be either of a non-contact type or a contact type. For example, it may be comprised of a roller to which a voltage can be applied. In this case, the effective charging area is the actual width which comes into contact with the photoreceptor surface.

(2) As the cleaning blade holding system in said cleaning unit, it is possible to employ a rotary type blade holder which is rotatable around the axis in parallel to the rotational axis of the photoreceptor and provides a definite contact pressing force to a cleaning blade utilizing a spring or gravity load.

(3) It is possible to employ rollers and brushes other than said scraper to remove toner which has been transferred from said cleaning roller.

(4) The toner employed in the present invention may be used in either one component developer or two-component developer, and may be either a magnetic toner or a non-magnetic toner.

Further, latent image development systems are not limited to the reversal development method.

(5) It is possible to apply various constitutions to the insulated part of the cleaning roller. For example, a whole roller may be constituted employing the same conductive/semi-conductive materials and may be constituted so that the part located beyond both ends of the part corresponding to the effective charging area obtained by the charging unit is covered with an insulating coating or tube.

In the image forming apparatus of the present invention, in addition to mechanical cleaning, employing a cleaning blade, electrostatic cleaning, employing a cleaning roller, is carried out. As a result, since basically high cleaning effects are exhibited, it is possible to assuredly remove residual toner on the image holding body. In addition, since effective cleaning area W1 obtained by the cleaning roller is set in the specified range, it is possible to allow the removal electric field formed between the photoreceptor and the cleaning roller to act on the specified area in the axis direction of said photoreceptor. As a result, it is possible to assuredly minimize interior apparatus staining due to toner adhesion as well as insufficient cleaning due to dielectric breakdown of the photosensitive layer of the photoreceptor, and to stably produce high quality images over an extended period of time.

Further, in the image forming apparatus of the present invention, due to the fact that the bias voltage applying means is a constant current power source, electric potential difference between the surface of the cleaning roller and the surface of the photoreceptor is formed so as to run electric current at a constant amount, and said electric potential difference is simultaneously adjusted so as to keep constant irrespective of the variation of the surface potential of the photoreceptor. As a result, it is possible to more assuredly minimize unevenness and insufficient cleaning due to the electric potential level and polarity of the photoreceptor, compared to the case in which a constant voltage power source is employed.

Still further, in the image forming apparatus of the present invention, the portion beyond both ends of the part corresponding to the effective charging area in the lateral direction of the cleaning roller is insulated. Since the opposite charge area, which is charged employing the cleaning roller and is not recharged employing the charging unit, is not formed on the surface of the photoreceptor, neither interior apparatus staining due to toner adhesion, nor insufficient cleaning due to dielectric breakdown of the photosensitive layer is formed. As a result, it is possible to maintain high cleaning performance over an extended period of time and to produce high quality images.

Further, insulting portions are formed on the cleaning roller. As a result, it is possible to assuredly minimize the problem in which toner, which has been recovered, is scattered on the side of the photoreceptor and re-adheres onto the photoreceptor.

In the cleaning unit of the present invention, the parts beyond both ends of the part, corresponding to the charging area of the photoreceptor, are insulated in the lateral direction of the cleaning roller. As a result, since the area beyond the effective charging area of the photoreceptor is not charged by the cleaning roller, neither interior apparatus staining due to toner adhesion nor insufficient cleaning due to dielectric breakdown of the photoreceptor occurs. As a result, it is possible to exhibit uniform cleaning effects over an extended period of time.

Example 3

In the examples described in FIG. 1(*b*), images were formed employing an image forming apparatus comprised of units carrying out each process of exposure, development, transfer, fixing, and cleaning.

Further, employed as the present photoreceptor was a negatively chargeable OPC photoreceptor. Negatively charged electrostatic latent images were formed on said photoreceptor and toner images were formed on said photoreceptor via reversal development utilizing a negatively charged toner.

The linear speed of the present photoreceptor was 370 mm/second. Further, a negatively chargeable toner of a volume average particle diameter of 6.5 $\mu$m was employed.

[A] Example of Embodiment 1

(1) Example A-1 i) Photoreceptor

The present photoreceptor A-1 was prepared as described below.

| <Interlayer> | |
|---|---|
| Titanium chelate compound (TC-750, manufactured by Matsumoto Seiyaku) | 30 g |
| Silane coupling agent (KBM05-3, manufactured by Shin-Etsu Kagaku Co.) | 17 g |
| 2-Propanol | 150 ml |

Said interlayer was applied so as to obtain a dried layer thickness of 0.5 mm onto an aluminum drum base body which had been machined to obtain a raw tube surface roughness of 1.4 $\mu$m.

| <Charge Generating Layer> | |
|---|---|
| Y type titanyl phthalocyanine | 60 g |
| Silicone-modified butyral resin (X-40-1211, manufactured by Shin-Etsu Kagaku Co.) | 700 g |
| 2-Butanone | 2000 ml |

were blended and dispersed for 10 hours employing a sand mill, whereby a charge generating layer coating composition was prepared. Said coating composition was applied onto said interlayer, employing a dip coating method, whereby a charge generating layer, having a dried layer thickness of 0.2 $\mu$m, was prepared.

| <Charge Transport Layer> | |
|---|---|
| Charge transport material (4-methoxy-4'-(4-methyl-α-phenylstyryl)triphenylamine) | 200 g |
| Polycarbonate (TS2050, manufactured by Teijin Kasei Co.) | 300 g |
| Dichloromethane | 2000 ml |

were blended and dissolved, whereby a charge transport coating composition was prepared. The resulting coating composition was applied onto said charge generating layer, employing a dip coating method to prepare a charge transport layer, having a dried layer thickness of 20 $\mu$m, whereby Present Photoreceptor A-1 was prepared.

(2) Example A-2

Present Photoreceptor A-2 was prepared as described below.

Present Photoreceptor A-2 was prepared in the same manner as Present Photoreceptor A-1, except that the raw tube surface roughness of the aluminum drum of Example A-1 was machined so as to result in 0.3 $\mu$m.

(3) Example A-3

Present Photoreceptor A-3 was prepared as described below.

An interlayer, a charge generating layer and a charge transport layer were prepared in the same manner as said Present Photoreceptor A-1.

| <Resinous Layer> | |
|---|---|
| Methyltrimethoxysilane | 150 g |
| Phenyltrimethoxysilane | 30 g |
| Antioxidant (Exemplified Compound 1-8) | 1 g |
| 2-propnol | 225 g |
| 2 percent Acetic acid | 106 g |
| Tris (acetylacetonato) aluminum | 4 g |
| Colloidal silica (30 percent methanol dispersion, manufactured by Nissan Kagaku Co.) | 103 g |

were blended to prepare the coating composition of a resinous layer. The resulting coating composition was applied onto said charge transport layer so as to obtain a resinous layer having a dried layer thickness of 2.5 μm, employing a circular amount regulating type coating apparatus. The resulting coating was then heated and hardened at 110° C. for one hour, whereby a siloxane based resinous layer having a cross-linked structure was formed. Thus Present Photoreceptor A-3 was prepared.

(4) Comparative Example A-1

Comparative Example A-1 was prepared as described below.

Comparative Example A-1 was prepared in the same manner as Present Photoreceptor A-1, except that the aluminum base body employed to prepare Present Photoreceptor A-1 was subjected to mirror grinding.

(5) Comparative Example A-2

Comparative Photoreceptor A-2 was prepared in the same manner as Present Photoreceptor A-1 except that an aluminum drum base body was employed which had been machined to result in a raw tube surface roughness of 2.5 μm.

Surface roughness Rz of Present Photoreceptors A-1 through A-3 and Comparative Photoreceptors A-1 and A-2 was determined employing a surface roughness meter (Surfcorder SE-30H, manufactured by Kosaka Kenkyusho Co.). Measurement conditions as well as measurement results are described below.

Measurement Conditions

Measurement rate: 0.1 mm/second

Measurement distance: 15 mm

Trace: 2 μm

Measurement Results

| | Surface Roughness Rz (in μm) |
|---|---|
| Present Photoreceptor A-1 | 1.80 |
| Present Photoreceptor A-2 | 0.35 |
| Present Photoreceptor A-3 | 2.40 |
| Comparative Photoreceptor A-1 | 0.05 |
| Comparative Photoreceptor A-2 | 2.80 |

ii) Cleaning Roller

The cleaning roller was comprised of conductive foamed urethane, and was comprised of an elastic roller having a surface resistivity of $10^3$ Ω/□ and a hardness of 30 degrees. Said roller was prepared by winding urethane onto a ϕ6 mm metal shaft so as to form ϕ16 mm (having a thickness of 25 mm) and was brought into contact with said photoreceptor to result in a contact width of 2 mm.

Said roller moved in the normal direction to said photoreceptor in the contact area at a circumferential speed ratio of 1:1.

iii) Bias Voltage

A current at 20 μA and a positive bias voltage were applied to said cleaning roller employing a constant current power source.

iv) Removal Means

A scraper made of SUS was brought into contact with said cleaning roller utilizing a counter system.

v) Cleaning Blade

A cleaning blade comprised of urethane rubber, having a thickness of 2.0 mm, a free length of 10 mm, and a hardness of 70 degrees, was brought into contact with said photoreceptor at a contact angle of 15 degrees, utilizing a counter system. The contact load was 20 g/cm.

vi) Developer

A two-component developer comprised of a toner and a carrier was employed. Said toner, having a volume average particle diameter of 6.5 μm, was prepared employing a granulation polymerization method.

Image formation experiments, employing 200,000 sheets, were carried out under the conditions previously described and the ambient conditions described below. The following results were obtained.

a. High temperature and high humidity from the fist to the 100,000th sheet (30° C. and 80 percent relative humidity)

b. Normal temperature and normal humidity from the 100,001st to the 200,000th sheet (20° C. and 50 percent relative humidity)

i) Examples A-1 through A-3 resulted in no blade curl-under and produced high quality images during image formation of all 200,000 sheets.

ii) Comparative Example A-1 resulted in curl-under at a very early stage (image formation of 10,000 sheets), and image forming experiments had to be terminated.

iii) Comparative Example A-2 produced excellent images until the image formation of the 130,000th sheet in the same manner as examples. However, after the image formation of the 130,001st sheet, insufficient cleaning occurred due to abrasive wear of the cleaning blade, whereby black streaks and white streaks were formed on images. Said problems were more pronounced as the image formation proceeded, and the image formation was terminated at the 150,000th sheet.

[B] Example of Embodiment 2 i) Photoreceptor (1) Example B-1

Photoreceptor (hereinafter referred to as Present Photoreceptor) B-1 according to the present embodiment was prepared as described below.

After dispersing a mixture consisting of 10 weight parts of conductive titanium oxide (coated with tin oxide, having an average primary particle diameter of 0.4 μm), 10 weight parts of a phenol resin precursor (being a resol type), 10 weight parts of methanol, and 10 weight parts of butanol, employing a sand mill, the resulting dispersion was dip-coated onto an aluminum cylinder. After hardening the resulting coating at 140° C., a conductive layer having a volume resistivity of $5\times10^9$ Ωcm and a thickness of 20 μm was provided.

Subsequently, 10 weight parts of methoxymethylated nylon (at a ratio of methoxymethylation of about 30 percent) having the structural formula described below

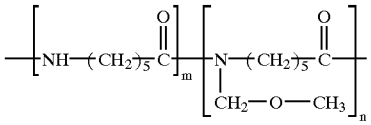

and 150 weight parts of isopropanol were mixed and dissolved. Thereafter, the resulting composition was applied onto said conductive layer, whereby a 1 μm thick sublayer was provided.

Subsequently, a mixture consisting of 4 weight parts of TiOPc having strong peaks at 9.5 degrees and 27.1 degrees at a diffraction angle of 2θ±0.2 degrees of X-ray diffraction spectra of CuKα, 2 weight parts of polyvinyl butyral (having the trade name of Eslex BM2, manufactured by Shin-Etsu Kagaku), and 60 weight parts of methyl ethyl ketone were dispersed for 4 hours in a sand mill employing ϕ1 mm glass beads, whereby a charge generating layer dispersion was prepared. The resulting dispersion was dip-coated and a 0.3 μm thick charge generating layer was provided.

Then, a mixture consisting of 10 weight parts of triphenylamine having the structural formula described below,

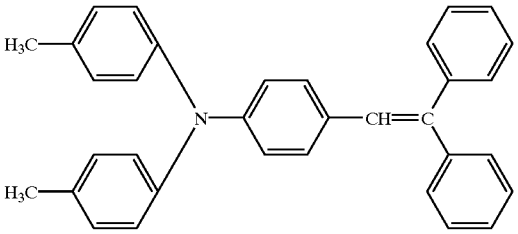

10 weight parts of a polycarbonate resin (Bisphenol Z, having a viscosity average molecular weight of 20,000), 50 weight parts of monochlorobenzene, and 15 parts of dichloromethane was blended while stirring. Thereafter, the resulting composition was dip-coated onto said charge generating layer, whereby a 20 μm thick charge transport layer was provided.

Subsequently, a mixture consisting of 30 weight parts of acryl based monomer having the structural formula described below,

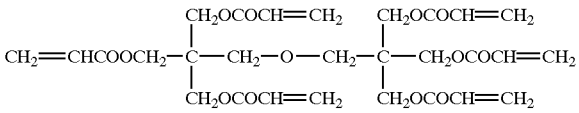

50 weight parts of ultra fine tin oxide particles having an average particle diameter of 400 Å prior to dispersion, 20 weight parts of fine polytetrafluoroethylene resinous powder (having an average particle diameter of 0.18 μm), 18 weight parts of 2-methylthioxanthone as the photopolymerization initiator, and 150 weight parts of ethanol was dispersed employing a sand mill over 66 hours.

The resulting composition was dip-coated onto said charge transport layer so as to form a layer. The resulting layer was photo-hardened for 60 seconds under a light intensity of 800 W/cm$^2$ employing a high-pressure mercury arc, and subsequently dried at 120° C. for 2 hours by a hot airflow, whereby a surface layer was prepared. The thickness of the resulting surface layer was 3 μm.

(2) Examples B-2 and B-3

Present Photoreceptors B-2 and B-3 were prepared as described below.

An aluminum drum, a conductive layer, a sublayer, a charge generating layer, and a charge transport layer, which were the same as Example B-1, were prepared.

Subsequently, 30 weight parts of acryl based monomers, 50 weight parts of fine tin oxide particles, 2 weight parts of fine polytetrafluoroethylene resinous powder, 18 weight parts of a photopolymerization initiator, and 150 parts of ethanol, each of which were the same as Example B-1, were dispersed over 66 hours, employing a sand mill.

Further, separately, 30 weight parts of acryl based monomers, 50 weight parts of ultra fine tin oxide particles, 6 weight parts of fine polytetrafluoroethylene resinous powder, 18 weight parts of the photopolymerization initiator, and 150 weight parts of ethanol, each of which were the same as Example B-1, were dispersed employing a sand mill over 66 hours. Each of these compositions was coated onto said charge transport layer employing a dip coating method to form a layer under the same conditions as Example B-1, whereby a 3 μm thick surface layer was prepared.

(3) Comparative Example

Comparative Example was prepared as described below.

A photoreceptor, wherein fine polytetrafluoroethylene resinous powder was not blended in the surface layer of Present Photoreceptor B-1, was designated as Comparative Photoreceptor.

[Contact Angle]

The contact angle of photoreceptor drum surface to pure water was determined employing a dripping type contact angle meter, and subsequently compared. As a result, Example B-1 photoreceptor resulted in a large contact angle of 118 degrees and was subjected to achievement of a low energy surface. By contrast, said comparative photoreceptor resulted in a relatively small contact angle of 80 degrees, whereby a low energy surface was not achieved.

ii) Cleaning Roller

The cleaning roller was comprised of conductive foamed urethane, and was comprised of an elastic roller having a surface resistivity of $10^3$ Ω/□ and a hardness of 30 degrees. Said roller was prepared by winding urethane onto a ϕ6 mm metal shaft so as to form ϕ16 mm (being a thickness of 25 mm) and was brought into contact with said photoreceptor to result in a contact width of 2 mm.

Said roller moved in the normal direction to said photoreceptor in the contact area at a circumferential speed ratio of 1:1.

iii) Bias Voltage

A current at 20 μA and a positive bias voltage were applied to said cleaning roller employing a constant current power source.

iv) Removal Means

A scraper made of SUS was brought into contact with said cleaning roller utilizing a counter system.

v) Cleaning Blade

A cleaning blade comprised of urethane rubber, having a thickness of 2.0 mm, a free length of 10 mm, and a hardness of 70 degrees, was brought into contact with said photoreceptor at a contact angle of 15 degrees, utilizing a counter system. The contact load was 20 g/cm.

vi) Developer

A two-component developer comprised of a toner and a carrier was employed. Said toner, having a volume average particle diameter of 6.5 μm, was prepared employing a granulation polymerization method.

Image formation experiments, employing 200,000 sheets, were carried out under the conditions previously described and the ambient conditions described below. The following results were obtained.

a. Normal temperature and normal humidity from the 1st to the 100,000th sheet (20° C. and 50 percent relative humidity)

b. Low temperature and low humidity from the 100,001th to the 200,000th sheet (10° C. and 20 percent relative humidity)

It was confirmed that Examples B1 through B3 resulted in sufficient cleaning until the image formation of the 200,000th sheet and were capable of consistently outputting high quality images without image problems such as white streaks.

Comparative Example resulted in excellent images during the initial stage (until the 100,000th sheet). However, in the image formation after the 130,000th sheet, insufficient cleaning occurred due to excessive abrasive wear of the cleaning roller surface, whereby white streaks and black streaks were formed on the images. Said trend became more pronounced as the image formation proceeded. At the completion of the image formation of the 150,000th sheet, in order to continue the image formation, white streaks as well as black streaks were eliminated by increasing the current of the bias power to +55 μA. However, acceptable images were not obtained due to discharge generation from the cleaning roller to the photoreceptor.

Example 4

Production of Toners T1 and T2 (Example of Emulsion Polymerization Method)

Added to 10.0 liters of deionized water was 0.90 kg of sodium n-dodecyl sulfate, which was dissolved while stirring. Gradually added to the resultant solution were 1.20 kg of Regal 330R (carbon black, manufactured by Cabot Co.), and stirred well for one hour. Thereafter, the resultant mixture was continuously dispersed for 20 hours, employing a sand grinder (a medium type homogenizer). The resultant dispersion was designated as "Colored Dispersion 1". Further, a solution comprised of 0.055 kg of sodium dodecylbenzenesulfonate and 4.0 liters of deionized water was designated as "Anionic Surface Active Agent Solution A".

A solution comprised of 0.014 kg of nonyl phenyl polyethylene oxide 10-mole addition product and 4.0 liters of deionized water was designated as "Nonionic Surface Active Solution B". A solution prepared by dissolving 223.8 g of potassium persulfate in 12.0 liters of deionized water was designated as "Initiator Solution C".

Placed into a 100-liter GL (glass lining) reaction tank, fitted with a thermal sensor, a cooling pipe, and a nitrogen gas introducing device, were 3.41 kg of wax emulsion (polypropylene emulsion having a number average molecular weight of 3,000, a number average primary particle diameter of 120 nm, and a solid portion concentration of 29.9 percent), all of "Anionic Surface Active Agent Solution A", and all of "Nonionic Surface Active Agent B", and the resultant mixture was stirred. Subsequently, 44.0 liters of deionized water were added.

When the mixture was heated to 75° C., all of "Initiator Solution C" was added dropwise. Thereafter, while maintaining the temperature of the mixture at 75±1° C., 12.1 kg of styrene, 2.88 kg of n-butyl acrylate, 1.04 kg of methacrylic acid, and 548 g of t-dodecylmercaptan were added dropwise. After finishing dropwise addition, the mixture was heated to 80±1° C. and stirred for 6 hours while being heated. Subsequently the resultant mixture was cooled to not more than 40° C., and stirring was terminated. Said mixture was filtered employing a pole filter and the resultant filtrate was designated as "Latex (1)-A".

Incidentally, the glass transition temperature of resinous particles in Latex (1)-A was 57° C., and the softening point of the same was 121° C. The molecular weight distribution of the same exhibited parameters such as a weight average molecular weight of 12,700 and a weight average particle diameter of 120 nm.

Further, a solution, prepared by dissolving 0.055 kg of sodium dodecylbenzene sulfonate in 4.0 liters of deionized water, was designated as "Anionic Surface Active Agent Solution D". Still further, a solution prepared by dissolving 0.014 kg of nonyl phenol polyethylene oxide 10-mole added product in 4.0 liters of deionized water was designated as "Nonionic Surface Active Agent Solution E".

A solution, prepared by dissolving 200.7 g of potassium persulfate (manufactured by Kanto Kagaku Co.) in 12.0 liters of deionized water, was designated as "Initiator Solution F".

Placed into a 100-liter GL reaction tank, fitted with a thermal sensor, a cooling pipe, a nitrogen gas introducing device, and a comb-shaped baffle, were 3.41 kg of wax emulsion (polypropylene emulsion having a number average molecular weight of 3,000, a number average primary particle diameter of 120 nm, and a solid portion concentration of 29.9 percent), all of "Anionic Surface Active Agent Solution D", and all of "Nonionic Surface Active Agent E", and the resultant mixture was stirred. Subsequently, 44.0 liters of deionized water were added. When the mixture was heated to 70° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added dropwise. Thereafter, while maintaining the temperature of the mixture at 72±2° C., stirring was carried out for 6 hours while being heated. The temperature was further raised to 80±2° C., and stirring was carried out for 12 hours while being heated. The resultant solution was cooled to not more than 40° C., and stirring was terminated. Filtration was carried out employing a pole filter, and the resultant filtrate was designated as "Latex (1)-B.

The glass transition temperature of resinous particles in Latex (1)-B was 58° C., and the softening point of the same was 132° C. The molecular weight distribution of the same exhibited parameters such as a weight average molecular weight of 245,000 and a weight average particle diameter of 110 nm.

A solution, prepared by dissolving 5.36 kg of sodium chloride as the salting-out agent in 20.0 liters of deionized water, was designated as "Sodium Chloride Solution G".

A solution, prepared by dissolving 1.00 g of a fluorine based nonionic surface active agent in 1.00 liter of deionized water, was designated as "Nonionic Surface Active Agent Solution H".

Placed into a 100-liter SUS reaction tank, fitted with a thermal sensor, a cooling pipe, a nitrogen gas introducing device, and a particle diameter and shape monitoring device (a reaction apparatus in which the crossed axis angle α is set at 20 degrees) were 20.0 kg of Latex (1)-A and 5.2 kg of Latex (1)-B prepared as described above, 0.4 kg of colorant dispersion, and 20.0 kg of deionized water and the resultant mixture was stirred. Subsequently, said mixture was heated at 40° C., which was added to Sodium Chloride Solution G, 6.00 kg of isopropanol (manufactured by Kanto Kagaku Co.) and Nonionic Surface Active Agent Solution H in said order. Thereafter, the mixture was set aside for 10 minutes and then heated to 85° C. over 60 minutes. At 85±2° C., the mixture was stirred from 0.5 to 3 hours, so that the particle diameter increased under salting-out/fusion. Subsequently, 2.1 liters of pure water was added, to terminate the increase in the particle diameter.

Placed into a 5-liter reaction vessel, fitted with a thermal sensor, a cooling pipe, and a particle diameter and shape monitoring device were 5.0 kg of the fused particle dispersion prepared as described above, and the shape was controlled while stirring at the dispersion temperature of 85±2° C. from 0.5 to 15 hours. Thereafter, the resultant dispersion was cooled to not more than 40° C. and stirring was terminated. Subsequently, classification was carried out in the suspension by a centrifugal sedimentation method employing a centrifuge, and the resultant mixture was filtered employing a 45 μm opening-sieve. The resultant filtrate was designated as Association Liquid (1). Subsequently, wet cake-like non-spherical particles were collected from said Association Liquid (1) through filtration, employing glass filter and then washed with deionized water.

The resultant non-spherical particles were dried employing a flash jet drier at an intake air temperature of 60° C., and subsequently dried at 60° C., employing a fluidized-bed dryer. Externally blended with 100 parts, by weight, of the obtained colored particles were one part by weight of fine silica particles and 0.1 part by weight of zinc stearate, employing a Henschel mixer, and thus toners shown in the table below were obtained which were prepared employing the emulsion polymerization association method.

Toner T1 and Toner T2 shown in Table 4-1 were obtained by controlling the stirring rotation rate and the heating time during monitoring of said salting-out/fusion stage as well as the shape controlling process, and further by adjusting the particle diameter and the variation coefficient of the grain size distribution.

TABLE 4-1

| Toner No. | Ratio of Shape Coefficient of 1.0 to 1.6 (in percent) | Ratio of Shape Coefficient of 1.2 to 1.6 (in percent) | Variation Coefficient of Shape Coefficient (in percent) | Ratio of Toner Particles having no Coroners (in percent) |
|---|---|---|---|---|
| Toner 1 | 82.5 | 68.3 | 15.2 | 88 |
| Toner 2 | 63.9 | 62.0 | 17.4 | 53 |

| Toner No. | Number Average Particle Diameter (in μm) | Variation Coefficient of Number Distribution (in percent) | Sum M of $m_1$ and $m_2$ (in percent) |
|---|---|---|---|
| Toner 1 | 5.6 | 25.9 | 80.7 |
| Toner 2 | 5.4 | 25.9 | 68.5 |

A ferrite carrier in an amount of 200.1 g having a volume average particle diameter of 45 μm, which had been coated with styrene-methacrylate resin, was blended with each of 19.8 g of said toners 1 and 2, and Developers for the evaluation were prepared.

On a cylindrical aluminum electrically conductive support an inter layer was provided, on which the organic light semiconductor layer was provided to prepare the photoreceptor for an photoreceptor. The organic light semiconductor layer was composed of a charge generation layer containing charge generation material, phthalocyanine pigment, having thickness of 0.5 μm, and a charge transfer layer formed by coating triphenyl amine based charge transfer material dissolved in polycarbonate resin having thickness of 25 μm.

(Image Forming Apparatus)

Aforesaid photoreceptor was installed in a digital copier, Konica 7033, manufactured by Konica Corp., which basically had the same structure as the image forming apparatus in FIG. 1(*b*). The charging potential of the image section and the potential in the maximum image density section were adjusted to −750 V and −100 V, respectively, and reversal development was carried out.

Further, said copier was modified and a set of two of each cleaning members prepared as described below was installed.

(Cleaning Member)

Cleaning Member A

Said member was a roller having a volume resistivity of $10^4$ Ω.cm, comprised of conductive foamed urethane, which was brought into contact with the photoreceptor. The circumferential speed ratio in the contact section was such that photoreceptor:roller=1:1.1.

A scraper for removing recovered toner was installed, while electric current was not applied. The toner removal ratio on the surface of the photoreceptor was 55 percent.

Cleaning Member B

Said member was constituted in the same manner as Cleaning Member A, but electric current of +10 μA was applied. The toner removal ratio on the surface of the photoreceptor was 75 percent.

Cleaning Member C

Said member was constituted in the same manner as Cleaning Member A, but an electric current of +10 μA was applied. The toner removal ratio on the surface of the photoreceptor was 95 percent.

Cleaning Member D

Said member was a rayon brush roller.

Said member was brought into contact with the photoreceptor, and the circumferential speed ratio in the contact section was that of the photoreceptor:roller=1:1.2.

A flicker bar for removing recovered toner was installed, while an electric current was not applied. The toner removal ratio on the surface of the photoreceptor was 30 percent.

Cleaning Member E

Said member was a urethane rubber blade, having a hardness of 70 degrees, a thickness of 2.0 mm and a free length of 10 mm.

Said blade was brought into contact with the photoreceptor so as to form a contact angle of 10 degrees to its surface. The contact load was set at 120 mN/cm. The toner removal ratio on the surface of the photoreceptor was 90 percent.

Cleaning Member F

The same conditions as Cleaning Member E were set except that the contact load was varied to 50 mN/cm. The toner removal ratio on the surface of the photoreceptor was 40 percent.

PROPERTIES EVALUATION

At the combinations shown Table 4-2 below, imaging tests employing 200,000 copy sheets were carried out.

The test to the 100,000th sheet was carried out at normal temperature and normal humidity (20° C. and 50 percent relative humidity), while from the 100,001st to the 150,000th sheet was low temperature and low humidity (10° C. and 20 percent relative humidity), and from the 150,001st sheet, was a high temperature and high humidity (30° C. and 80 percent relative humidity).

Regarding evaluation items; insufficient cleaning (insufficient residual toner removal), image problems (white streaks and black streaks), the photoreceptor surface and copy images were visually observed.

TABLE 4-2

| | First Cleaning Member | Second Cleaning Member | Toner | Insufficient Cleaning | Image White Streaks | Image Black Streaks | Remarks |
|---|---|---|---|---|---|---|---|
| Example 4-1 | A(55%) | E(90%) | 1 | good to the 200,000th copy | none | none | |
| Example 4-2 | C(95%) | E(90%) | 1 | good to the 200,000th copy | none | none | |
| Example 4-3 | E(90%) | D(30%) | 1 | good to the 200,000th copy | none | none | |
| Example 4-4 | B(75%) | A(55%) | 1 | good to the 200,000th copy | none | none | |
| Comparative Example 4-1 | D(30%) | C(95%) | 1 | occurred at about the 120,000th copy | occurred at about the 140,000th copy | occurred at about the 120,000th copy | |
| Comparative Example 4-2 | F(40%) | E(90%) | 1 | occurred at about the 140,000th copy | occurred at about the 150,000th copy | occurred at about the 140,000th copy | |
| Example 4-5 | C(95%) | E(90%) | 2 | good to the 200,000th copy | slightly occurred at about the 150,000th copy | none | interior apparatus staining due to scattering, generation of white streaks due to stained charging pole |

Figures in parentheses are the toner removal ratio.

In Examples 4-1 through 4-4, excellent images were obtained until the 200,000th copy. On the other hand, in Comparative Examples 4-1 and 4-2, image problems due to insufficient cleaning occurred and each test was suspended.

In Example 4-5, properties were slightly degraded compared to Example 4-1 through 4-4. The resulting degradation was assumed due to an increase in the range of charge amount caused by the extremely deformed toner particle shape.

According to the present invention, it is possible to provide an image forming apparatus and an image forming method which is capable of resulting in stable cleaning properties over an extended period of time and of forming high quality images without formation of image problems such as white streaks and black streaks.

What is claimed is:

1. An image forming apparatus, comprising:

a rotationally driven photoreceptor;

a charging device to-electrically charging the photoreceptor;

an exposing device to imagewise exposing the photoreceptor so that a latent image is formed on the photoreceptor;

a developing device to develop the latent image with toner so that a toner image is formed on the photoreceptor;

a transfer device to transfer the developed image to a recording material; and a cleaning unit which removes residual toner on said photoreceptor which has passed a transfer zone in which a toner image formed on said photoreceptor is transferred to a recording material in which said cleaning unit comprises a cleaning roller which is disposed so as to come into contact with a surface of said photoreceptor, a bias voltage applying means which applies a bias voltage to said cleaning roller, and a flat board-shaped cleaning blade comprised of an elastic body which is disposed so that a leading edge of said cleaning blade comes into contact with the surface of said photoreceptor downstream from said cleaning roller with respect to a movement direction of said photoreceptor, and said cleaning blade is supported rotatably around predetermined rotationally driven center axis O parallel to a rotational axis of said photoreceptor so that said cleaning blade is rotationally driven from a standard state in which the leading edge comes into contact with the surface of said photoreceptor while its total shape is not deformed and subsequently, is subjected to a working state while its entire body is curved, and the position of said rotationally driven center axis O is set so that said cleaning blade, in the standard state, satisfies the Conditions (1) and (2):

Condition (1): in the cross-section perpendicular to the rotational axis of said photoreceptor, straight line T drawn between contact position P of the leading edge of said cleaning blade with said photoreceptor and said rotationally driven center axis O is positioned between tangential line N at said contact position P and said cleaning blade, and Condition (2): in the cross-section perpendicular to the rotational axis of said photoreceptor, contact angle θ of said cleaning blade with respect to the tangential line of said photoreceptor at said contact point P is from 0 to 30 degrees.

2. The image forming apparatus of claim 1 wherein said cleaning blade has a contact load from 5 to 50 g/cm.

3. The image forming apparatus of claim 1 wherein the bias voltage applying means is a constant current power source.

4. An image forming apparatus, comprising:

a rotationally driven photoreceptor;

a charging device to electrically charging the photoreceptor;

an exposing device to imagewise exposing the photoreceptor so that a latent image is formed on the photoreceptor;

a developing device to develop the latent image with toner so that a toner image is formed on the photoreceptor employing toner comprising a lubricant as an external agent;

a transfer device to transfer the developed image to a recording material in a transfer zone; and a cleaning unit which removes residual toner on said photoreceptor which has passed said transfer zone, wherein said cleaning unit comprises a cleaning roller which is disposed so as to come into contact with a surface of said photoreceptor, a bias voltage applying means which applies a bias voltage to said cleaning roller, and a flat board-shaped cleaning blade comprised of an elastic body which is disposed so that a leading edge of said cleaning blade comes into contact with the surface of said photoreceptor downstream from said cleaning roller with respect to a movement direction of said photoreceptor, and which comprises a control mechanism comprising a specified toner image forming function which forms a toner image for maintaining a blade effect to maintain a desired cleaning effect of said cleaning blade which reaches a cleaning zone employing said blade after passing said transfer zone.

5. The image forming apparatus of claim 4 wherein the control mechanism is capable of allowing said toner image for maintaining a blade effect to reach said cleaning zone, in which said cleaning blade is employed, by decreasing the cleaning effect obtained by said cleaning roller.

6. The image forming apparatus of claim 4, wherein the specified toner image forming function of said control mechanism controls the operation of said image forming unit so that said toner image for maintaining the blade effect is formed at every specified forming frequency.

7. The image forming apparatus of claim 4 wherein a toner employed to form the toner image comprises toner particles having a volume average particle diameter of 8.5 $\mu$m or less, which are prepared employing a polymerization method.

8. The image forming apparatus of claim 4 wherein the toner employed to form a toner image may be comprised of toner particles, having a volume average particle diameter of 8.5 $\mu$m or less, which are prepared employing a polymerization method.

9. An image forming apparatus, comprising:

a rotationally driven photoreceptor having an axis a charging device to electrically charging the photoreceptor which is arranged so as to face said photoreceptor while maintaining parallel to the axis;

an exposing device to imagewise exposing the photoreceptor so that a latent image is formed on the photoreceptor;

a developing device to develop the latent image with toner so that a toner image is formed on the photoreceptor employing toner comprising a lubricant as an external agent;

a transfer device which is arranged to face the photoreceptor while maintaining parallel to the axis and transfers a toner image on the photoreceptor onto a recording material in a transfer zone; and a cleaning unit which removes the toner on said photoreceptor which passes through said transfer zone, in which said cleaning unit comprises a cleaning blade which comes into contact with a surface of said photoreceptor, a cleaning roller which comes into contact with the surface of said photoreceptor upstream with respect to the movement direction of said photoreceptor and is arranged to maintain parallel to the axis of said photoreceptor, and a bias voltage applying means which applies a bias voltage to said cleaning roller, is characterized in that formulas (1) and (2) described below are satisfied;

$$W2 < W1 \quad \text{Formula (1)}$$

$$|W3 - W1| \leqq 30 \text{ (in mm)} \quad \text{Formula (2)}$$

wherein W1 is an effective cleaning area obtained by said cleaning roller in the axis direction of said photoreceptor, W2 is an effective transferring area of said transfer device and W3 is an effective charging area of said charging device.

10. The image forming apparatus of claim 9 wherein the bias voltage applying means is a constant current power source.

11. The image forming apparatus of claim 9 wherein the cleaning roller is insulated in lateral direction in the part which is located beyond the part corresponding to the area effectively charged by said charging unit.

12. The image forming apparatus of claim 9 wherein the bias voltage applying means in said cleaning unit is a constant current power source.

13. The image forming apparatus of claim 9 wherein the cleaning roller is conductive in its lateral direction in the part corresponding to the area in which the surface of said photoreceptor is effectively charged by said charging unit and is simultaneously insulated in the part beyond both edges of the part corresponding to said effectively charged area.

14. The image forming apparatus of claim 9 wherein surface roughness Rz of the photoreceptor is from 0.1 to 2.5 $\mu$m.

15. The image forming apparatus of claim 9 wherein constant current power source outputs a constant current of 1 to 50 $\mu$A.

* * * * *